US011738834B2

(12) United States Patent
Norling

(10) Patent No.: US 11,738,834 B2
(45) Date of Patent: Aug. 29, 2023

(54) MARINE FENDER

(71) Applicant: Auctoritas, LLC, Madbury, NH (US)

(72) Inventor: John C. Norling, Madbury, NH (US)

(73) Assignee: Auctoritas, Inc., Madbury, NH (US)

( * ) Notice: Subject to any disclaimer, the term of this patent is extended or adjusted under 35 U.S.C. 154(b) by 16 days.

(21) Appl. No.: 17/239,492

(22) Filed: Apr. 23, 2021

(65) Prior Publication Data

US 2021/0331772 A1 Oct. 28, 2021

Related U.S. Application Data

(60) Provisional application No. 63/015,357, filed on Apr. 24, 2020.

(51) Int. Cl.
*B63B 59/02* (2006.01)

(52) U.S. Cl.
CPC ..... *B63B 59/02* (2013.01); *B63B 2059/025* (2013.01)

(58) Field of Classification Search
CPC .... B63B 59/00; B63B 59/02; B63B 2059/025
USPC ..... 114/219
See application file for complete search history.

(56) References Cited

U.S. PATENT DOCUMENTS

| | | | | |
|---|---|---|---|---|
| 2,536,551 | A * | 1/1951 | Johnson | B63B 59/02 114/219 |
| 5,299,521 | A * | 4/1994 | Loucks | B63B 59/02 114/219 |
| 5,697,316 | A | 12/1997 | Kinkead | |
| 6,021,729 | A * | 2/2000 | DeRuscio | B63B 59/02 114/219 |
| 8,156,883 | B2 * | 4/2012 | Sheedy | B63B 59/02 114/219 |
| 2003/0005873 | A1 | 1/2003 | Vretta | |
| 2009/0151615 | A1 | 6/2009 | Sheedy | |

FOREIGN PATENT DOCUMENTS

| | | | |
|---|---|---|---|
| EP | 3190042 | A1 | 7/2017 |
| KR | 20110000578 | U | 1/2011 |
| KR | 20130015389 | A | 2/2013 |
| KR | 20150047304 | A | 5/2015 |

* cited by examiner

*Primary Examiner* — Lars A Olson
(74) *Attorney, Agent, or Firm* — Loginov & Associates, PLLC; William A. Loginov

(57) ABSTRACT

A marine fender can stick to, and conform to, the hull of a boat and protect the hull from abrasions and impacts. It can remain attached to the side of the boat despite motion of the boat and hard impacts or friction with neighboring objects. The marine fender can be rapidly and straightforwardly applied to, and/or removed from, the side of the boat hull. A boat can be protected by a number of individual fenders, and the group of fenders can be dissembled from each other when desired, and stowed in a relatively small area.

20 Claims, 22 Drawing Sheets

MARINE FENDER

RELATED APPLICATION

This application claims the benefit of U.S. Provisional Application No. 63/015,357, entitled MARINE FENDER, filed Apr. 24, 2020, the teachings of which are expressly incorporated herein by reference.

FIELD OF THE INVENTION

This invention relates to removable protective layers or barriers for a vehicle, and more particularly to fenders for use with watercraft and/or vessels.

BACKGROUND OF THE INVENTION

Boat fenders are a ubiquitous piece of gear employed on vessels of all types and sizes. They are used to prevent a dock or other adjacent structure from scratching, gouging, piercing or other damaging the vessel (also termed simply a "boat") due to the constant motion experienced by the boat due to flowing, rising and falling water and when a boat is landing at or departing from a dock. The fender acts as a bumper to maintain a space between the boat hull and the dock (or other structure). It is generally constructed from durable material that flexes to absorb the force generated between the hull and the dock so that, under most conditions, the hull remains untouched by the dock edge. The most common boat fender design is a round, air-filled bladder attached to the end of a line (rope). This bladder is typically hung over the side of the hull and positioned between the boat and the dock by securing the line to a cleat or other fixed structure on the boar (e.g. a stanchion). Their cylindrical nature allows them to roll out of place if the boat moves significantly relative to the dock. They also only protect a narrow area of the overall hull, whereby objects, other boats, pilings, etc., can strike the hull between the protected areas. Also, while fender material is fairly robust (e.g. a sturdy vinyl) it may lack any reinforcement to contact surfaces, which can result in damaging abrasion (due to constant motion and contact with hard or rough surfaces) that may lead to failure of this unprotected surface. This level of continuous motion and resulting force is often associated with a storm or other surge. They also only protect a narrow area of the overall hull, whereby objects, other boats, pilings, etc., can strike the hull between the protected areas. This level of force is often associated with a storm or other surge. Moreover, these types of fenders can simply become untied, or the lines can detach due to breakage of a grommet, at which time, they fall off and float away, leaving the hull fully exposed.

It is further recognized that generally cylindrical fenders can act as a form of roller bearing with respect to the dock so that the motion between the hull and dock causes the generally cylindrical fenders to roll back and forth along the boat hull. As they roll, they can work various grit and sand into the hull, causing abrasion. More active seas can cause the fenders to eventually roll completely out of an interfering position between the hull and dock. This can lead to a phenomenon known as "dock rash." Dock rash can include the marring of the finish on the hull, puncturing or breaching of the hull, or even separation of decks from hulls, which often leads to sinking. Various techniques have been proposed and/or produced to assist fenders in remaining in place. Some use one or two large suction cups to attempt to secure the fender in place, but the shape of the fender and force applied thereto usually overwhelm any holding force. While some commercially available fenders are flat, these also disadvantageously slide around during rough seas, and are notorious for destroying hull finishes. Existing non-inflatable foam fenders are also subject to punctures and tears.

In general, existing fender designs can fail in any number of ways including deflating, moving out of place, tearing, falling off, etc. It is desirable to provide a more robust design that avoids these disadvantages and limitations.

SUMMARY OF THE INVENTION

This invention overcomes disadvantages of the prior art by providing a boat hull fender that can be adhered to a hull to protect a boat hull, even in extreme conditions such as storms or areas of heavy wakes or when the boat is in motion, as when docking. The boat fender described herein can be adhered to the side of the boat hull, and can be secondarily attached to the boat using a rope. A multiplicity of boat fenders can be linked together to form a skirt/panoply of protective coverage surrounding the boat.

In an illustrative embodiment, a marine fender can include an outer shell, an adherence structure and/or layer adapted to secure the marine fender to a boat hull, a cushion situated between the outer shell and the adherence structure/layer, and a plurality of mooring or fixation points adapted to tie/secure the fender to a boat/vessel. The cushion can be constructed from a variety of materials and generally includes a dampening and shock-absorbing medium (e.g. gas, gel, air, etc.) within an enclosed space or spaces. The adherence structure/layer can include a plurality of suction cups. The plurality of suction cups can include main suction cups and secondary suction cups, and the main suction cups can be larger than the secondary suction cups, and the secondary suction cups can be positioned the spaces between the main suction cups. The adherence structure/layer can include a microsuction sheet. The cushion can be a closed cell foam with an array of small, air/gas-filled voids or a larger bladder with or without (free-of) inner baffles. The adherence structure/layer can include a plurality of adhering dimples that are cup shaped indentations in the cushion, or more-conventional suction cups. The outer shell or cover can be shock and abrasion-resistant material that can be pliable, and/or rigid (and a single or multiple layers thereof), having an appropriate thickness—for example between approximately 1/16 inch and 1/2 inch (such thickness being based in part upon the material properties of the shell/cover). In an embodiment, a polymer, such as HDPE. In an embodiment, the cushion can include approximately three inches of medium density polyethylene closed cell foam. In another embodiment, the cushion can define a single cell and/or baffled bladder filled with pressurized gas (e.g. air) or gel, and can define a cylindrical or non-cylindrical (e.g.) D-shape with a flattened bottom that defines the adherence structure/layer, with suction cups mounted thereon.

In an illustrative embodiment, a marine bow fender can include a first side and a second side, each of the first side and the second side including an outer shell, an adherence structure/layer adapted to secure the marine fender to a boat hull, a cushion situated between the outer shell and the adherence structure/layer, at least one mooring point adapted to tie the fender to a boat or another fender, and wherein the first side and the second side meet at a spine, so that the first side and the second side extend in two directions out from the spine.

In various embodiments, the adherence structure can more generally comprise (a) a plurality of suction cups at predetermined locations, (b) a microsuction sheet or (c) a nanosuction sheet. The plurality of suction cups each define an elastomeric cup adhered to a portion of the adherence structure. Illustratively, the outer shell or cover can comprise a rigid or polymer that conforms to a shape of the portion of the cushion. In various embodiments, the fender can include appropriate fixation points for ropes/lines. In various embodiments, cushion comprises a foam material or an inflatable and deflatable bladder. The foam can be a medium density, closed-cell foam (e.g.) polyethylene material. The bladder can comprise a conventional, cylindrical boat fender and the adherence structure includes cradling cushions that cradle the bladder and define an approximately flattened bottom to which the suction cups are attached. The shell can be secured with respect to the adherence structure by a flexible fabric retaining structure. Illustratively, lateral retaining cords can encircle each of opposing ends of the bladder, or pass through fixation points on the opposing ends of the bladder, respectively. Additionally, the cradling cushions can either (a) extend continuously along a portion of the longitudinal length of the bladder or (b) reside adjacent opposing ends of the bladder. Illustratively, the bladder defines an approximate D-shaped cross section with an approximately flattened side and an opposing, semi-cylindrical or curved side, the shell being secured against the semi-cylindrical or curved side and the suction cups being attached to the flattened side. The flattened side can include one or more recesses between each of opposing ends, constructed and arranged to receive retaining cords or straps attached to each of opposing edges of the shell. Additionally, the shell can include formations that interengage with associated formation of the bladder to secure the shell and the bladder together. In various embodiments, the bladder can define an approximate D-shaped cross section with a semi-cylindrical or curved side, the shell being secured against the semi-cylindrical or curved side and an opposing V-shaped side with the suction cups being attached to the each of a pair of flattened sections of the V-shaped side, the suction cups being adapted to engage opposite sides of a bow of the hull.

In an embodiment, a method of protecting a boat using a fender in accordance with the embodiment herein is provided. The method includes (a) attaching a rope to a fixation point of a marine fender; (b) securing the rope to the boat, so that the fender is tied to the boat; and (c) biasing an adherence layer of the fender onto the hull of the boat.

BRIEF DESCRIPTION OF THE DRAWINGS

The invention description below refers to the accompanying drawings, of which.

DETAILED DESCRIPTION

A marine fender can be applied, and adhere to the hull of a boat, so as to protect the hull from abrasions and impacts. It can remain attached to the side of the boat despite motion of the boat and hard impacts or friction with neighboring objects. The marine fender can be straightforwardly and rapidly applied to the side of the boat hull, and removed in an equally straightforward and rapid manner. The boat hull can be protected by a number of individual fenders, and the group of fenders can be dissembled and stored in a relatively small area.

Figure 1:
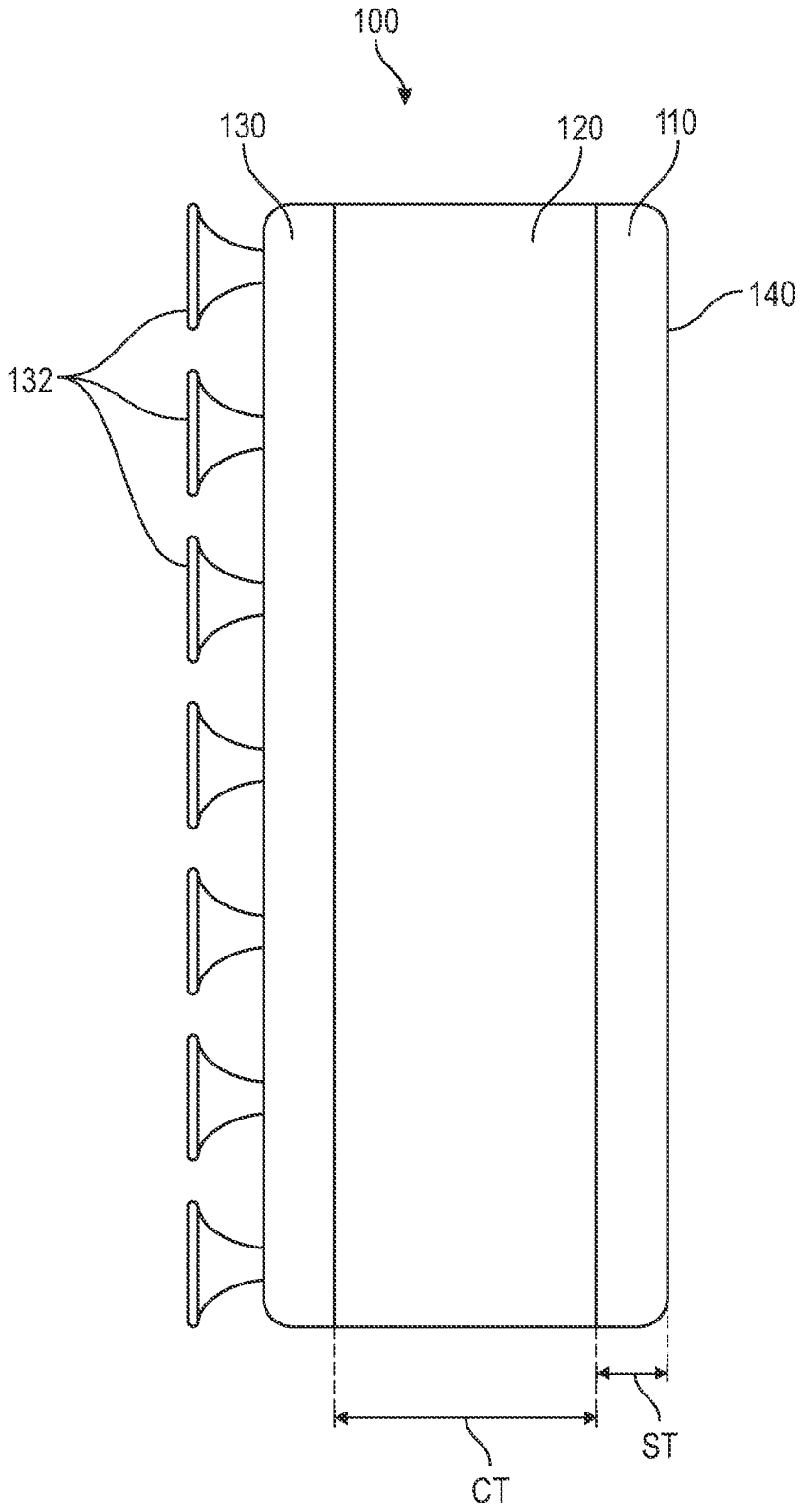
FIG. 1 is an side view of a boat fender, showing the various layers thereof, according to an illustrative embodiment.

FIG. 1 is a side view of a boat fender 100, according to an illustrative embodiment, in which the various layers that make up the fender's overall construction are depicted. In alternate arrangements, the side of the fender can be sealed so that the layers are not readily visible. In an exemplary embodiment, the boat fender 100 can include an outer shell 110, a resilient layer, or cushion, 120, and an adherence structure (or "layer" in this embodiment) 130. The outer shell 110 can act as a layer of armor that can block neighboring objects from impacting against a boat that is protected by the fender 100. The outer shell 110 can be made from a sufficiently hard material so that it can block impacts and also resist abrasion from neighboring objects. Various plastics can be used, including relatively hard plastics. In various embodiments, the outer shell 110 can be made from high-density polyethylene (HDPE), and the outer shell 110 can have a shell thickness ST of (e.g.) approximately 1/16-1/4 inch. In various embodiments, different shell thicknesses can be used with different sizes of vessels. Larger, heavier vessels can benefit from the increased protection afforded by a thicker shell, such as an outer shell with a thickness of 1/4 inch or more, while smaller vessels may benefit from a fender with a thinner shell that can allow greater flexibility to more easily conform to the shape of the smaller hull. In various embodiments, the outer shell 110 can alternatively be made from wood, fiberglass, carbon fiber composite, aramid composite, hard rubber, or other appropriate materials, which combine reasonable resilience (bendability) with surface strength.

Notably, the outer shell 110 can be highly (substantially) resistant to abrasion, and can be "slippery," and/or have a low surface friction that allows neighboring objects to slide on the fender 100 in a manner that is generally free of gouging or marring or either contacting surface. By way of non-limiting example, HDPE has a low surface friction, and can be the outermost layer of the outer shell 110. While HDPE has a low surface friction, in various embodiments, a coating of low surface friction material, such as Teflon outer coating 140, can be used as an outer coating over an HDPE shell, or can be used as an outer coating over another shell material that would be less resistant to abrasion without the coating. The addition of a PTFE (e.g. Teflon®) outer coating 140 in various embodiments can increase the resistance of the shell of the fender to abrasion. A boat hull with a fender 100 can effectively slide against various objects without (free of) causing damage to the boat hull, and the ability of external objects to slide easily against the fender can reduce the effective impact force onto the hull by such external objects of all but (approximately) 90° impacts. The outer shell 110 can also distribute the force of an impact over a wide area of the hull to further protect the hull from impacts. The outer shell 110 can protect the boat from puncture, and can itself be puncture resistant to protect the other layers of the fender 100.

To enhance impact resistance of the illustrative fender 100, a resilient layer, or cushion layer 120 can be provided beneath (and permanently adhered to) the outer shell 110. The cushion layer 120 can be made from a wide variety of different cushioning materials (or combinations of such materials), including a flexible/pliable, closed or open-cell polymer foam padding. In various embodiments, the foam padding can include various sizes of cells, or air bladders. In various embodiments, the cushion 120 can be made from a medium density polyethylene closed-cell foam, and the cushion 120 can have a cushion thickness CT of approximately 2-6 inches, or more (3 inches in an example). The cushion layer 120 can effectively absorb force from impacts against the outer shell 110, and can significantly decrease the impact force that is transferred from an impact by an external object to the boat hull by absorbing and dissipating the impact energy. In various embodiments, different cushion thicknesses can be used with different sizes of vessels. Larger, heavier vessels can benefit from the increased protection afforded by a thicker cushion, such as a cushion with a thickness of 6 inch or more, while smaller vessels may benefit from a fender with a thinner cushion, such as 2 inches or less, that can allow greater flexibility to more easily conform to the shape of the smaller hull.

The illustrative fender 100 also includes an adherence structure/layer 130 that is adapted to adhere to the side of the boat hull. It is recognized that most boat hulls are relatively smooth, formed from fiberglass, steel, aluminum, or other materials, having a gelcoat and/or painted outer surface that is substantially non-porous. Well-maintained wood, steel or aluminum boats are, likewise, typically coated with a smooth, non-porous paint or varnish layer. Such surfaces allow for the use of the depicted adherence layer 130 of the fender 100, which includes a multiplicity of spaced-apart (often densely packed), small-diameter suction cups 132 that can interoperate to affix and maintain the fender 100 in the desired location on the boat hull. That is, the multiplicity of small-diameter suction cups in the adherence layer ensures that some number thereof will maintain in contact with the hull at all times, thereby resisting the undesirable sliding or rolling motions that are typical in conventional round and flat fenders. As the fender rubs against a surface, the non-adhered suction cups are urged to re-adhere to the hull surface, thereby ensuring that contact is maintained.

In various embodiments, the adherence layer 130 with suction cups 132 can be made from a thermoplastic elastomer (TPE) or another resilient material (e.g. soft polyurethane, synthetic or natural rubber, silicone, etc.). The suction cups 132 can be formed in a wide range of sizes, and in various embodiments, differing sizes/diameters of suction cups can be used in a single embodiment (as described further below). Notably, the size and placement of suction cups 132 in the adherence layer 130 can allow for the fender 100 to be held securely in place, but also allow the fender 100 to be readily removed from the hull when the user desires. To remove, the user can simply separate (e.g. by levering or peeling away) the adherence layer 130 from the boat hull. As no adhesive or other secondary material is used to apply the fender to the hull, the fender 100 typically deposits no substantial residue on the hull after the fender is removed.

The discrete layers of the fender 100 can be joined together using adhesive, welded together, or otherwise secured together so that the fender defines an integral unit. Alternatively, co-molding techniques can be employed to define a unitary structure in a manner clear to those of skill (described further below).

Figure 2:
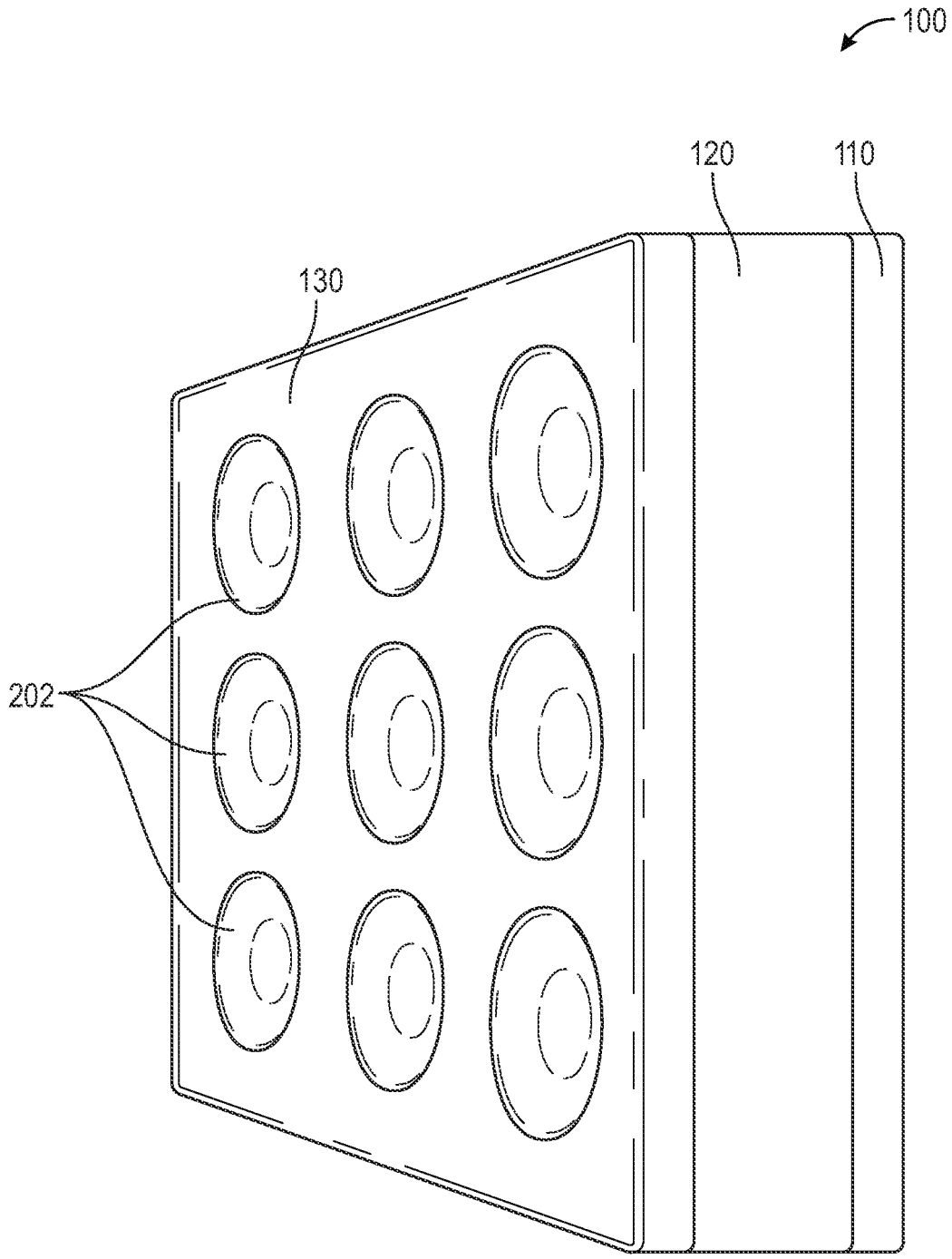
FIG. 2 is a perspective view of a boat fender with adhering divots, according to an illustrative embodiment.

In various embodiments, the fender 100 can be free of a separate adherence layer, and the function of the adherence layer 130 can be provided by, or defined as part of, the exposed face of the cushion layer 120. For the purposes of this description, thus, the "adherence layer" should be defined to include the exposed surface of another fender layer (e.g. the cushion layer 120). Thus, FIG. 2 shows a perspective view of a boat fender 100, according to an exemplary embodiment, in which the associated adherence layer 130 includes adhering divots. More particularly, the depicted adherence layer 130 can include a plurality of adhering dimples 202 that can be defined as indentations or divots in the cushion layer 120. Illustratively, the adhering dimples 202 can be cup-shaped divots in a closed-cell foam cushion layer, and they can act similar to suction cups by using vacuum pressure to hold the fender 100 in place on the boat hull.

Figure 3:
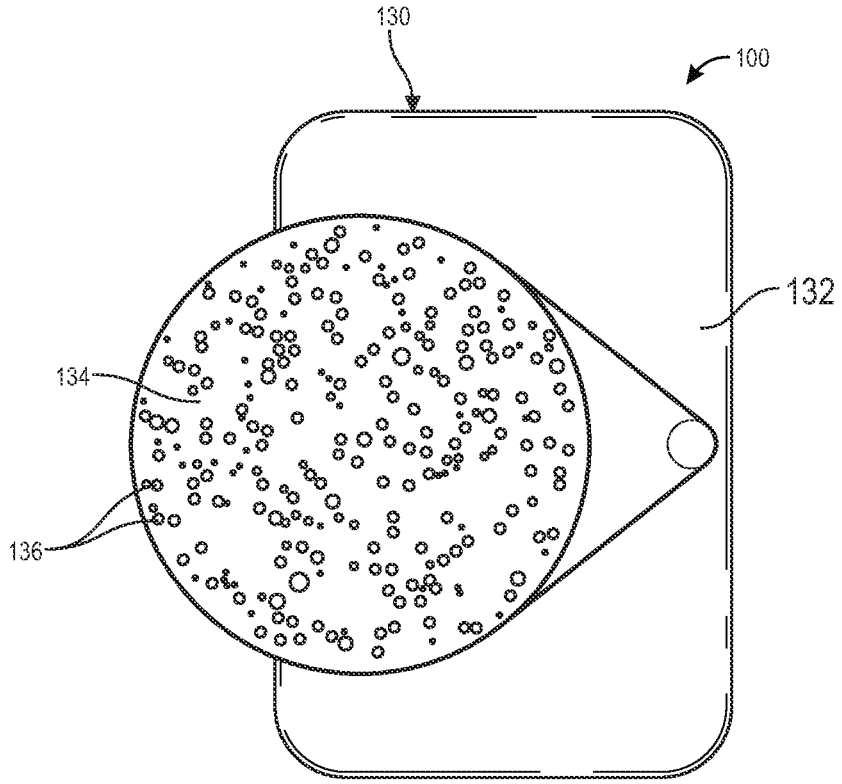
FIG. 3 is a rear view of a boat fender with an exemplary representation of a nanosuction adherence structure/layer, and showing an enlarged view, according to an illustrative embodiment.

FIG. 3 is a rear view of a boat hull fender 100 with a nanosuction adherence layer 130, according to an exemplary embodiment, including an enlarged view 134 of one such nanosuction element, according to an illustrative embodiment. While the depicted example illustrates a nanosuction sheet 132, in alternate embodiments, a microsuction layer can be employed (or a combination of nanosuction and microsuction structures. The nanosuction (or microsuction) sheet 132 can include very large array of microsuction/nanosuction cups (cavities) that each generate and hold a vacuum or negative pressure. In various embodiments, a fender with a nanosuction (microsuction) sheet can have (e.g.) millions of nanosuction (or microsuction) cups 136. Working together, this large number of nanosuction (or microsuction) cups 136 can allow the nanosuction (or microsuction) sheet 132 to maintain considerable, and continuous, holding force with respect to the hull surface. This holding force can be broken by levering or peeling the sheet from the hull in an incremental fashion when desired by a user.

Figure 4C:
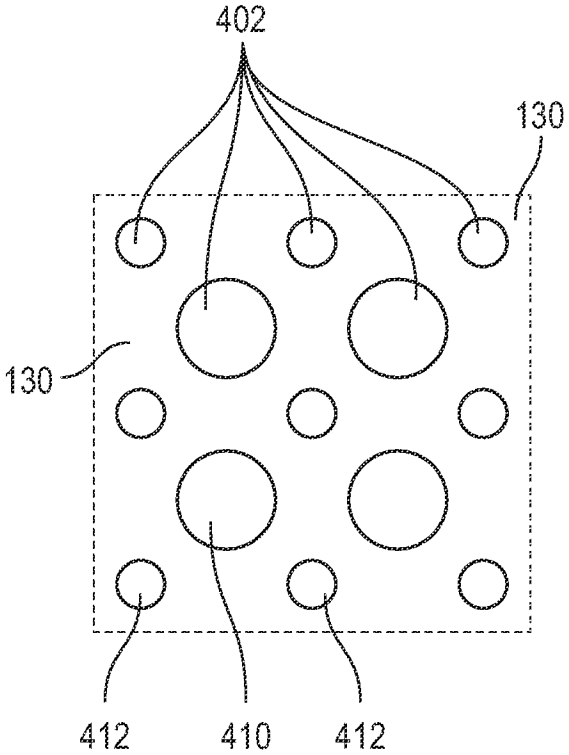
FIG. 4C is a rear view of a portion of a boat fender showing a third array of grippers, according to an illustrative embodiment.
Figure 4B:
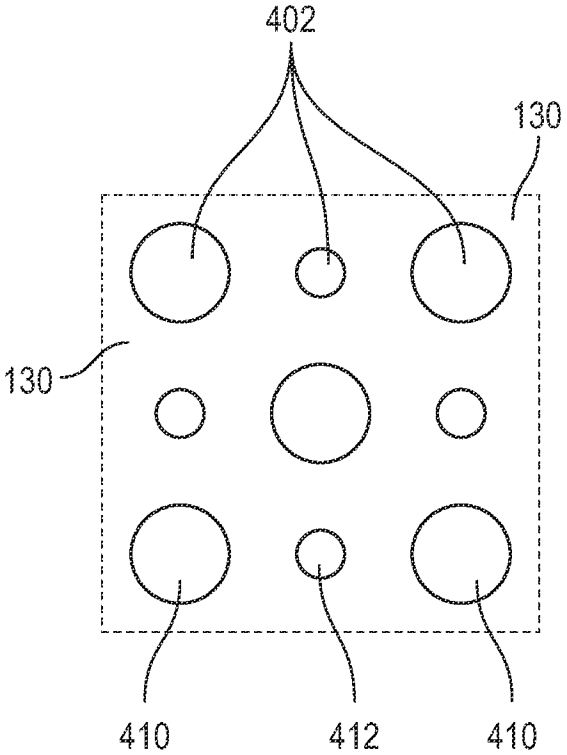
FIG. 4B is a rear view of a portion of a boat fender showing a second array of grippers, according to an illustrative embodiment.
Figure 4A:
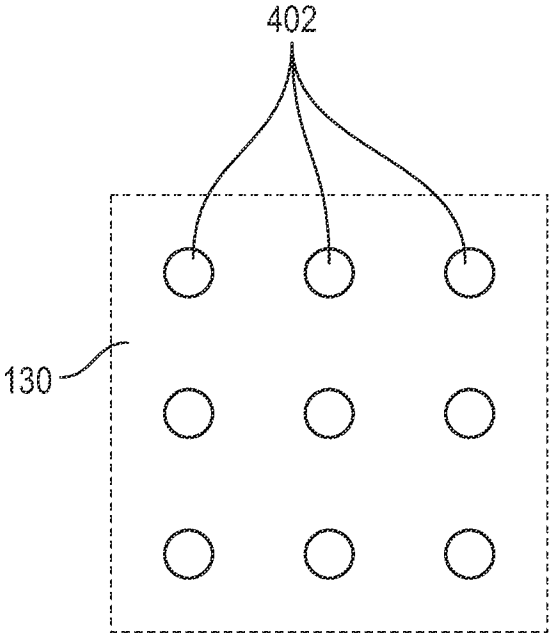
FIG. 4A is a rear view of a portion of a boat fender showing a first array of grippers, according to an illustrative embodiment.

FIG. 4A is a rear view of a portion of an exemplary boat hull fender showing a first array of grippers, according to an illustrative embodiment. Grippers 402 can be suction cups, adhering dimples, or other adherence features that are part of an adherence layer 130. The adherence layer 130 can include a wide range of possible distribution (numbers of) grippers 402 in a given area and overall. The array of grippers 402 can, likewise, be arranged according to a variety of patterns and/or with a variety of spacings between individual gripper elements. For example, the grippers 402 can be arranged in square, 90° (rectilinear) array, as shown in FIG. 4A, or alternatively, can be arranged in triangular arrays, hexagonal arrays, other polygonal layouts and/or various geometric arrangements.

FIG. 4B is a another rear view of a portion of a boat hull fender showing a second exemplary array of grippers, and FIG. 4C is yet another rear view of a portion of another exemplary boat hull fender showing a third exemplary array of grippers, according to an illustrative embodiment. In various embodiments, the grippers 402 can define various sizes, which can be uniform (FIG. 4A) of mixed (FIG. 4B) with a combination larger main grippers 410 and smaller secondary grippers 412, which can fill in the spaces (interstices) between the arrangement of larger main grippers 410. More generally, the number, size and arrangement of grippers (that can act as very small, discrete, suction cups), define the holding force of the fender which can be optimized to allow sufficient holding force without (free of) rendering the fender unnecessarily difficult to remove from the hull.

Figure 5:
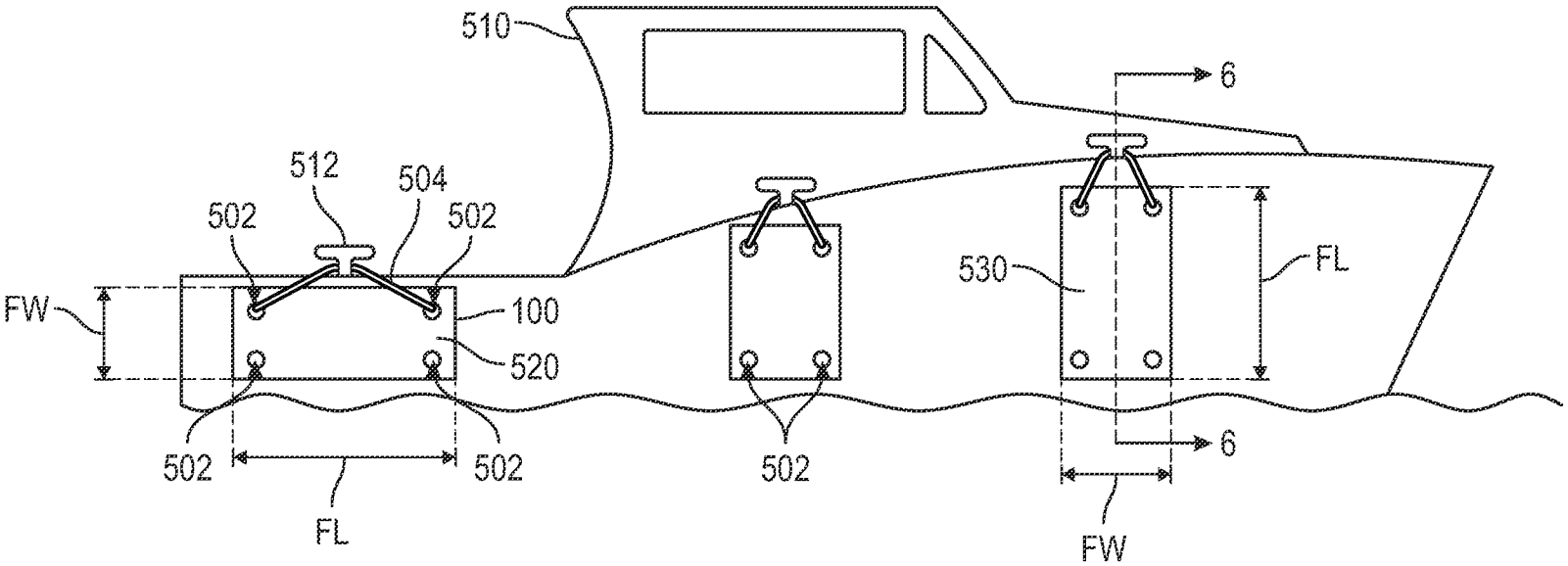
FIG. 5 is a side view of an exemplary boat hull with boat fenders applied thereto, according to an illustrative embodiment.

FIG. 5 is a side view of an exemplary boat hull 510 with attached boat fenders, according to an illustrative embodiment. The fenders can have mooring/fixation points 502 that are herein defined as holes through the fender 100, through which passes a rope 504. The mooring points 502 can alternatively define hooks, loops, cleats, or other structures that facilitate attachment of the rope 504 to the fender 100. The mooring points 502 and associated rope 504 are shown supporting the fenders relative to (e.g.) cleats or other deck structures on the boat hull 510. The rope(s) afford security and support for the fender(s) in the event the adherence layer becomes disconnected from the hull. In this manner the rope(s) act as secondary supports as the primary load bearing and adhesion force for the fender with respect to the hull can be provided by the adherence layer.

Notably, the layers of the fender are sufficiently pliable that the entire fender can bend to conform to the surface shape of the hull, thereby bringing all, or substantially all, of the adherence surface into contact with the hull. As noted above, should a part of the surface become detached, application of pressure, when the fender is biased by an external object (e.g. a dock) can re-adhere the surface to the hull.

Likewise, in the event that the entire adherence surface becomes detached from the hull, an applied pressure from an external object, or the user, should be sufficient to reattach it to the hull.

The fenders can be constructed/provided in various sizes, and the size can depend on, for example, the size of the boat, the type of dock, the degree of protection a user desires from storms, and/or other factors. A user can mount a plurality of differing, discrete sizes of fenders in different locations on the hull of a boat depending upon the above-factors. In various exemplary embodiments, a fender can have a fender length FL of up to approximately 24 inches, and a fender width FW of up to approximately 16 inches. Hence, the exemplary fender is rectangular. An individual fender can have multiple mooring points 502 that can allow it to be turned in different orientations (fender length FL being horizontal or vertical, as depicted by fenders 520 and 530, respectively in FIG. 5). In alternate embodiments, fenders can define any perimeter shape—square, polygonal, circular, ovular or other regular and/or irregular shapes.

Figure 6:
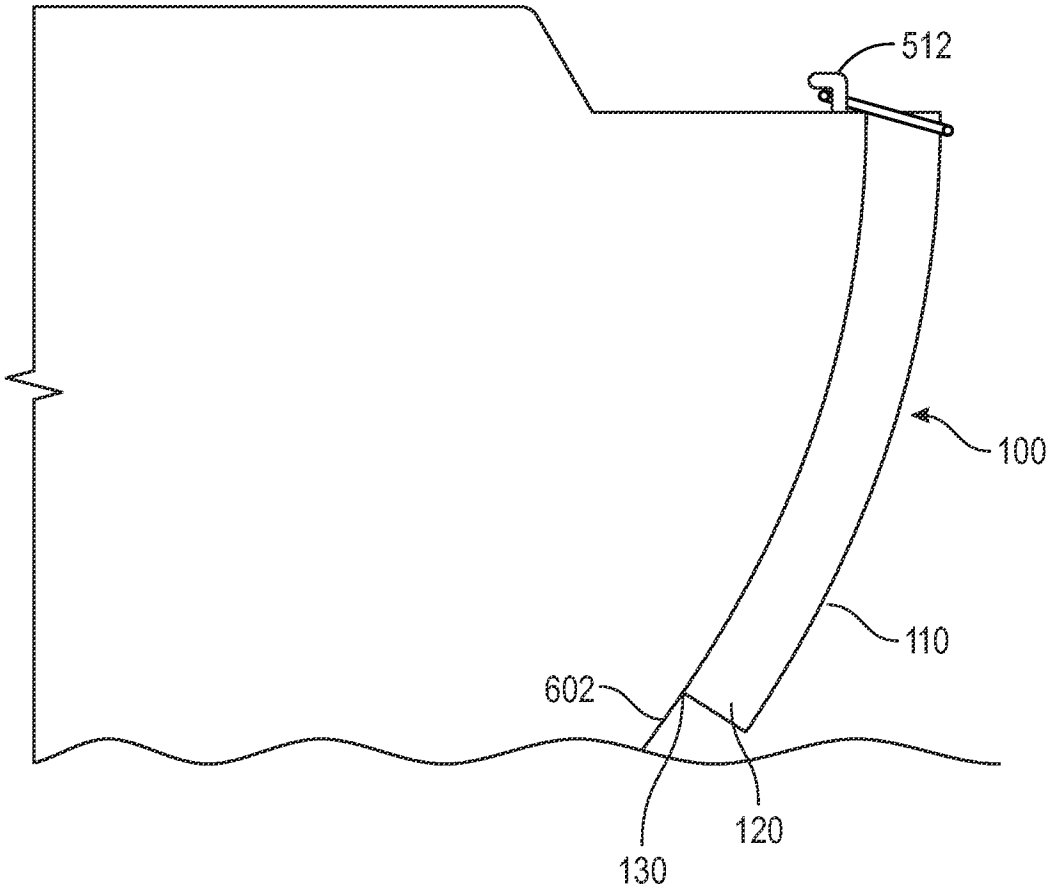
FIG. 6 is a cross section of a side of an exemplary boat hull with a boat fender applied thereto, taken along cross section line 6-6 of FIG. 5, according to an illustrative embodiment.

FIG. 6 is a cross section of a side of a boat with a boat fender, taken along cross section line 6-6 of FIG. 5, according to an exemplary embodiment. As described above, the laminated construction of the fender 100 is designed to elastically deform (flex) so as to conform to the shape of the boat hull 602. The fender's cushion layer 120 is made from a sufficiently soft, pliable foam so that it can flex and curve to follow the contours of the boat hull 602. The outer and inner (if fitted) layers 110 and 130, respectively, are designed to follow this flex with minimum resistance. Thus, the same fender 100 can be used on a wide range of boat hull shapes/contours. The adherence layer 130 can adhere the fender 100 to the side of the hull 602 so that the fender conforms to the shape of the hull. As also described above, the fender 100 can be secondarily attached by rope to a cleat or other structure on the boat side or deck, and the adherence layer 130 can simultaneously affix the fender snugly against the contour of the hull's outer surface.

Figure 7:
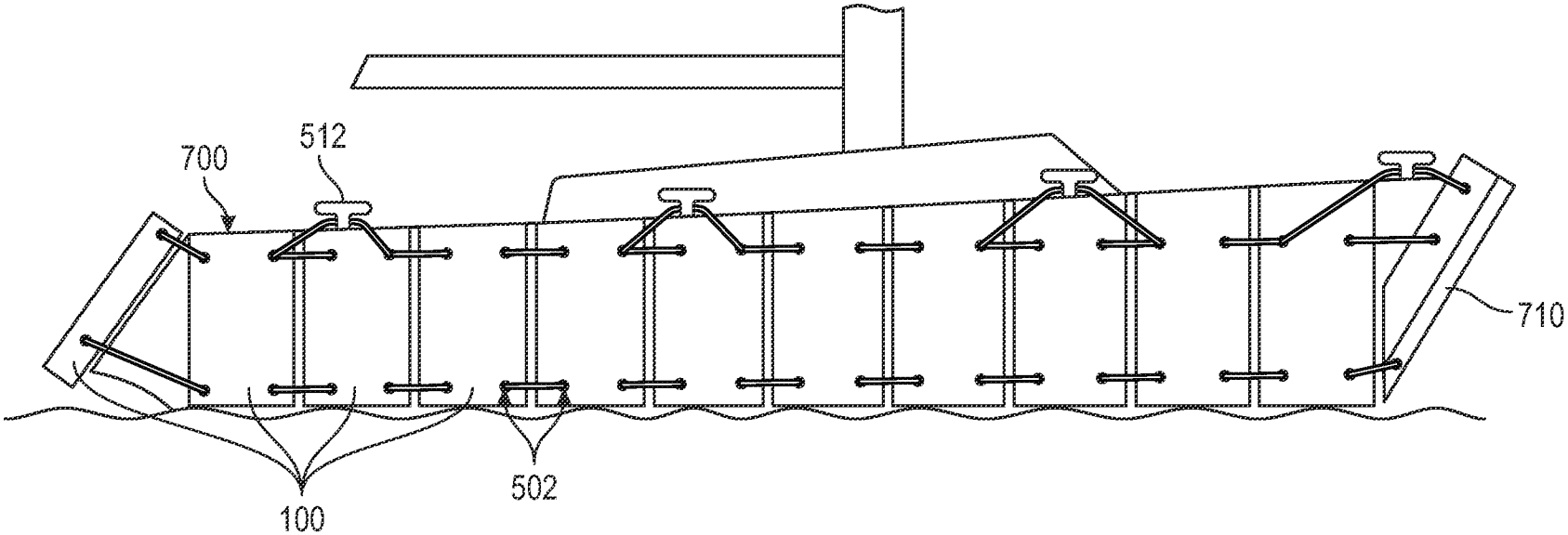
FIG. 7 is a side view of an exemplary boat hull with boat fenders applied thereto, for providing full coverage of a boat hull, according to an illustrative embodiment.

FIG. 7 is a side view of a boat hull with boat hull fenders described herein applied thereto, so as to provide substantially full protective coverage of a hull, according to an exemplary embodiment. An unlimited number of discrete (individual) fenders 100 of the same or differing sizes/shapes can be joined (festooned) together to form a protective skirt or panoply 700. As shown, a rope can be used to tie the mooring point 502 of one fender 100 to the mooring point 502 of an adjacent fender 100. This creates a substantially continuous chain of fenders that essentially define a single form-fitting unit against the hull's outer surface. Thus, the tied-together grouping of discrete fenders 100 can operate as a modular components in an overall structure of varying size and shape, which collectively defines the depicted protective skirt/panoply 700. As also shown in FIG. 7, the individual fenders are secured to each other, and the entire skirt/panoply 700 can be secondarily secured as a unit to the boat at cleats 512 (or similar structures). By way of non-limiting example, the skirt/panoply 700 depicts different shapes and sizes of fenders joined in the panoply, to define (e.g.) a bow fender 710 that (by way of example) can define the generalized shape of a chevron when viewed from an end.

Figure 8:
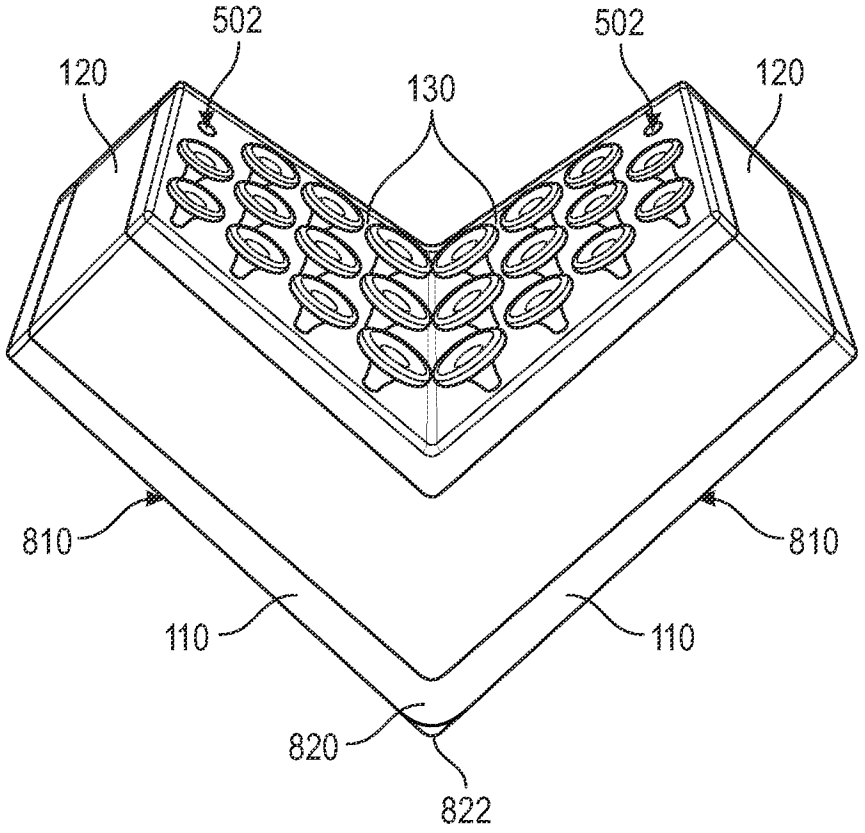
FIG. 8 is a perspective view of a bow fender for an exemplary boat hull, according to an illustrative embodiment.

FIG. 8 is a perspective view of a bow fender for a boat hull, according to an illustrative embodiment. The bow fender 710, can define two sides 810 that are typically joined at a front spine 820 that maintains an acute angle therebetween. The angle is highly variable. In general this joint angle can be smaller than the expected angle of the hull sides at the bow so that the sides 810 of the bow fender 710 are not significantly flared outwardly, and, instead must flex to engage the bow. This enhances the bow fender's attachment to the hull. The outer shell 110 on each of the two sides 810 can be divided or continuously bend around the front spine 820. In various embodiments, the front spine 820 can include additional reinforcement 822, which can comprise (e.g.) a thicker layer of material along the spine, and/or a row of interlaced scales of rugged material, so as to provide additional protection while also allowing the bow fender to flex along the shape of the bow. Other reinforcement material—e.g. rope casing, rubber sheet, etc. can be used as an alternative, or in addition to the above-described reinforcements. Similar to other modular fender segments described herein, each side 810 of the bow fender 710 can be constructed as a laminated arrangement with an outer shell 110, a cushion 120, an adherence layer 130 (when employed), and mooring points 502. More generally, the illustrative bow fender 710 is designed to flex and conform to the front of the boat in three dimensions, including the front of the bow and the hull sides at the bow.

Figure 9:
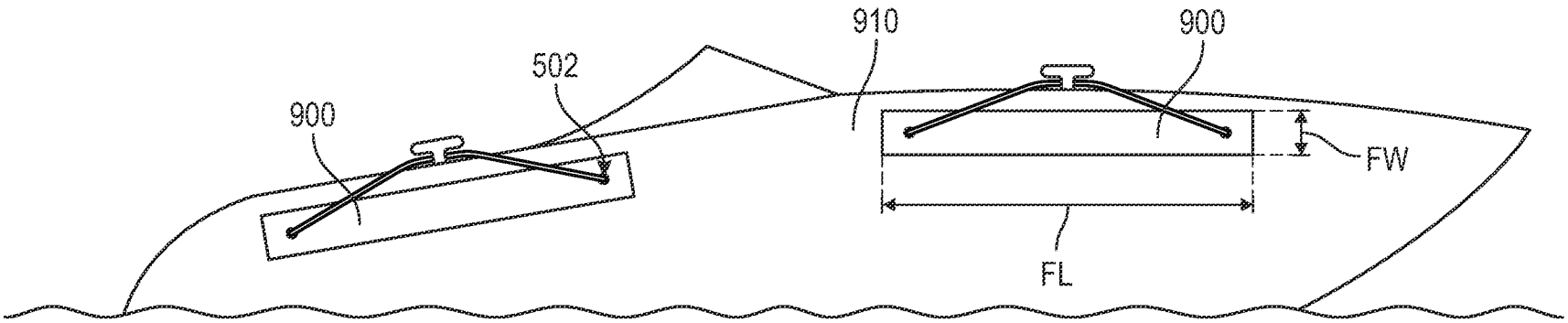
FIG. 9 is a side view of an exemplary boat hull with rub rail protection, according to an illustrative embodiment.

FIG. 9 is a side view of a boat hull with rub rail fenders constructed in accordance with the principles of the embodiments described herein. In particular, fenders can be sized and shaped to operate as rub rail fenders 900, which tend to be vertically short and elongated in the horizontal direction as shown. Similar to other fenders described above, the depicted rub rail fenders 900 can include a laminated construction with an outer shell, a cushion layer, an adherence layer (when employed), and mooring points 502 at appropriate locations along the fender. The illustrative rub rail fender 900 is particularly designed to protect, and be secured adjacent to, the rub rail 910, that can be an integral component of the boat hull, and is typically located at or near its topside. There are types of boats—for example high-performance powerboats and racing sailboats that may omit an integral or unitary rub rail structure along their hull. Thus, in various embodiments, the rub rail fender 900 can be used to protect a boat hull that omits (if free of) an integrated or unitary rub rail, so that the rub rail fender 900 can function as a structural rub rail for the boat hull—since such vessels may spend a large percentage of their non-running time out of the water. This leaves their hulls exceptionally prone to damage while fueling or at dock (e.g. between races). By way of non-limiting example, a rub rail fender can have a fender length RL of approximately 30 inches, and a fender width RW of approximately 5 inches, and can have a fender thickness that can be approximately 4 inches. In various exemplary embodiments, the dimensions of a rub rail fender can be highly variable. The depicted rub rail fenders 900 can be used for temporary docking, and can be quickly and easily secured in place, quickly and easily removed, and can be stored in a small area within the boat when the boat has left the dock. The adherence layer (which can be a unitary or integral part of the cushion layer's outer surface) ensures that they remain firmly attached to a given location on the hull, free of undesired sliding and shifting.

Advantageously, given the length and relatively narrow height of rub rail fenders 900, such can be generally smaller, and more easily stored in the boat while still providing significant protection to the upper portion of the hull. That is, a series of narrow rails can be stowed on deck or below in a manner that is less obtrusive than full sized fenders.

Figure 10:
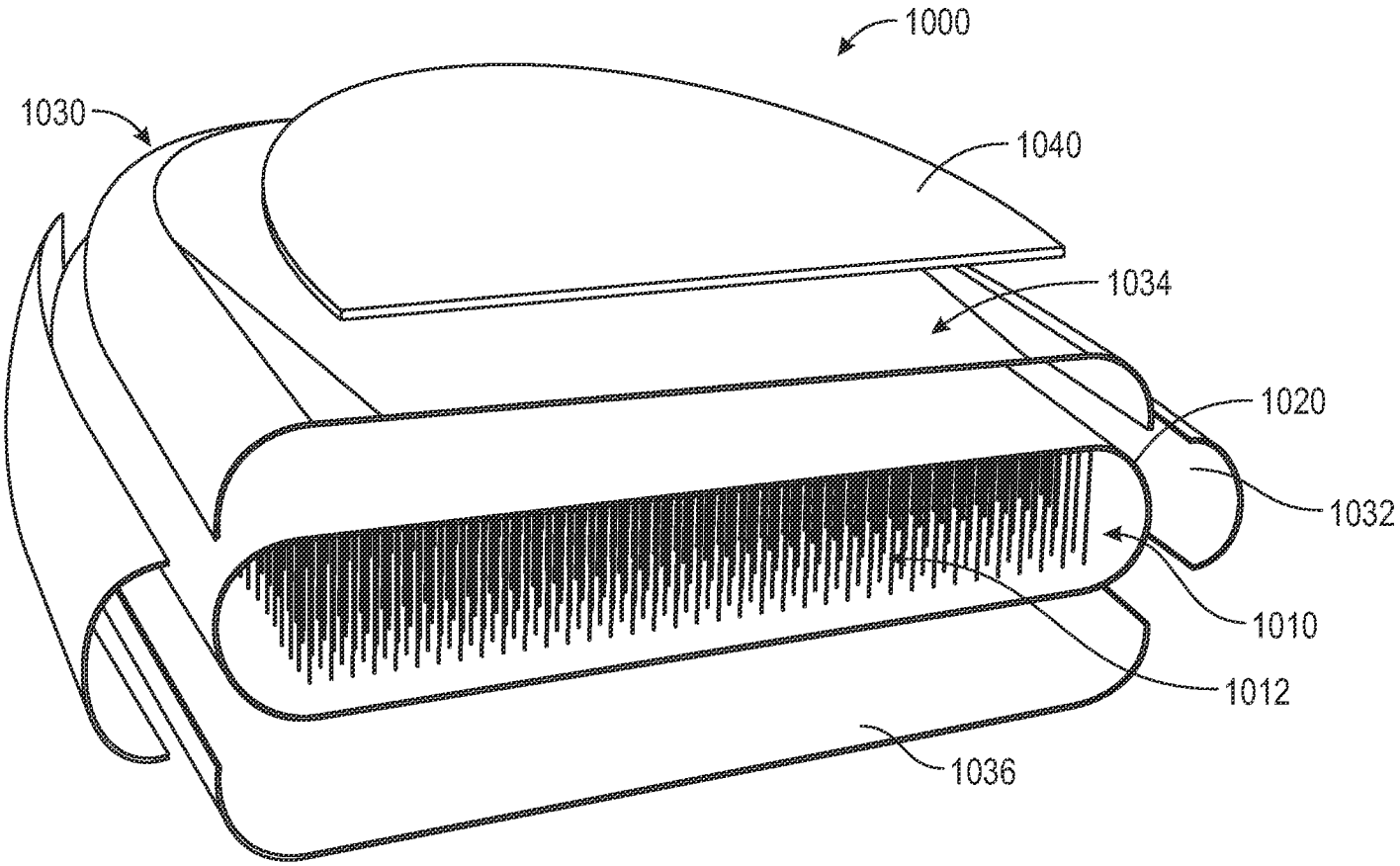
FIG. 10 is a partially cut away and exploded perspective view of an exemplary construction for use in providing an inflatable and deflatable fender assembly in accordance with the embodiments described herein.

In the above-described examples, the cushion layer is constructed from a soft, pliable material, such as closed cell foam. Recognizing that such foam is generally a series of small/microscopic bladders, each filled with gas (e.g. air), it is further contemplated that the gas-filled cells of the cushion layer can be larger—potentially defining an inflatable structure that otherwise provided the geometry and functionality described above. FIG. 10 is a partially cut away and exploded view of a construction for an inflatable, rigid item 1000—for example, based upon the concept of a commercially available inflatable paddle board, which can be employed in the construction of some or all of a fender (which the item 1000 shall also be referred to herein) with an associated, inflatable and deflatable cushion layer or air chamber 1010. By use of the exemplary, depicted air chamber 1010, the overall fender 1000 can be deflated when not in use, and stowed easily in a flattened state. By way of non-limiting example, the deflated cushion layer can reduce the overall thickness of the fender 1000 from, for example, approximately three inches (when fully inflated/deployed) to approximately one inch, or less (when deflated/stowed). More particularly, the depiction of FIG. 10 should be taken by way of non-limiting example of a technique for constructing a fender. In various embodiments, the actual fender construction can be widely variable. For example, the inflatable construction of the fender of FIG. 10 can be used as the central cushion layer in any of the embodiments described above, and can be appropriately shaped so as to define the desired overall fender perimeter shape. Such shape can be used to protect the side or bow of the vessel, or can be used as a rub rail (as described above).

In the depicted, exemplary embodiment, the fender 1000 can have a core chamber layer 1020 that is designed to sealingly contain the pressurized air (or other gas). The core chamber layer 1020 be made from a tarpaulin-PVC, or other durable, substantially non-porous material that can be impervious to air, or airtight, while also having the strength to hold air under force, such as the force of a shifting boat hull pressing the fender against a dock. The fender 1000 construction can also define one or more secondary chamber layers (not shown) that can be composed of similarly performing materials to that of the core chamber layer 1020, and can provide additional strength and/or air containment for the cushion 1000. Likewise, the core chamber can include (e.g.) fiber reinforcement as part of its moulded-in composition. The exemplary air chamber 1010 can be a drop-stitch inflatable chamber that is constructed using (e.g.) stitching 1012 within the air chamber 1010. The drop stitching 1012 can connect one side of the chamber to the other, and can provide additional strength and/or rigidity to the air chamber 1010.

The inflatable and deflatable fender 1000 can include exoskeleton or shell-like outer layer 1030 that protects the fender and its associated cushion layer from puncture under normal, expected use conditions. The shell-like outer layer 1030 can be constructed from (e.g.) PVC, HDPE, or other rigid material. In various embodiments, the shell-like outer layer 1030 can include multiple outer shell components, which can overlap with, and move/slide relative to one another, so that the outer shell can define a protective layer around the overall fender when the fender is inflated, while also allowing the fender to be deflated to a reduced thickness. In various embodiments, the outer shell layer 1030 can include one or more outer shell layer rails 1032 that can define a perimeter around the fender and protect its edges—including the top and bottom edges. The outer shell layer 1030 can further include an inner shell layer 1034. Moreover, an adherence layer 1040 can be disposed on the outside of, integrated with and/or unitary with, the inner shell layer 1034. A further outer layer 1036 can also be provided on the fender opposite the adherence layer where it faces obstacles. In various embodiments, outer layer 1036 can protect the chamber layer 1020 and can also form the outer shell of the fender. In various embodiments, an additional shell layer can cover the outer layer 1036 and can form the outer shell of the fender. This layer can be a durable material that resists puncture and abrasion. Note that the above-described inflatable fender structure can define a variety of layered constructions. In a generalized form, the illustrative fender 1000 (like the foam-based versions described above) includes, at least, an inflatable cushion layer (that can include drop stitching, cell dividers or other components for maintaining internal shape), a hull-engaging adherence layer and an exposed object-engaging durable/resilient shell layer—all of which are bendable and formable to the general contour of the hull. Also, it should again be noted that the specific arrangement, materials and functions of layers in the exemplary fender construction herein is highly variable and the structure depicted in FIG. 1 is shown by way of non-limiting example of the generalized concept of providing an inflatable rigid cushion layer to a fender as contemplated herein.

According to various embodiments, the fender can be constructed as a two piece construction with (a) an inflated and/or resilient bladder (constructed from vinyl, synthetic or natural rubber, and similar-performing materials), which adapted to absorb large impacts, and generally provide a spacing between the hull and another surface (e.g. dock); and (b) an overlying shell/cover of resilient material, such as fabric, or similar flexible material, including certain varieties of plastic (e.g. HDPE), plastic elastomers, neoprene, etc., or combinations of materials. The shell is removably (or permanently) secured as an integral component to the bladder using a variety of attachment mechanisms (described below). The bladder can be shaped so as to accommodate suction cups, as described above, for adherence to the hull surface in a manner that resists slippage. For example, the bladder can define a longitudinal; cross-section/profile with a flattened or concave bottom from which extends a curved perimeter (e.g.) a D-shape (also termed "semi-round"). Alternatively, a cylindrical (circular cross-section/profile) bladder can be used with a separate, integral suction cup base of appropriate size and shape.

Figure 11:
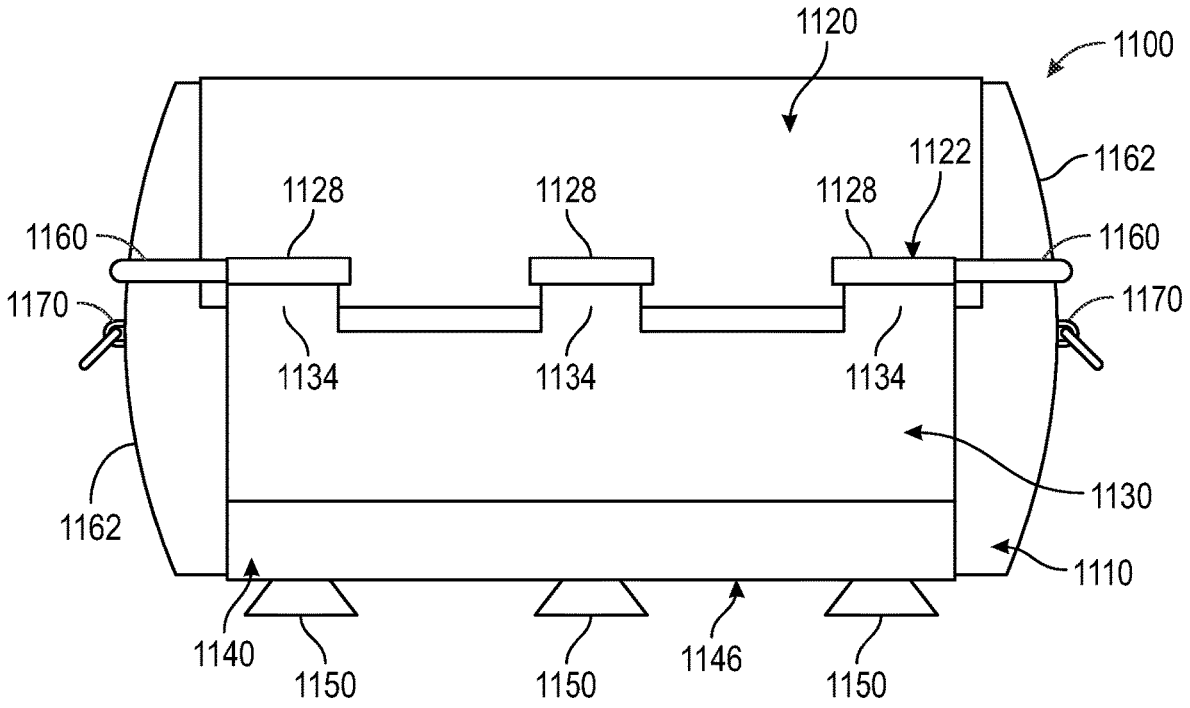
FIG. 11 is a side view of a rope-style (conventional) cylindrical, inflatable fender having a durable polymer shell mounted along one side thereof and an opposing adherence structure composed of cushioned (e.g. foam) base wedges with a flattened bottom and attached suction cups.
Figure 12:
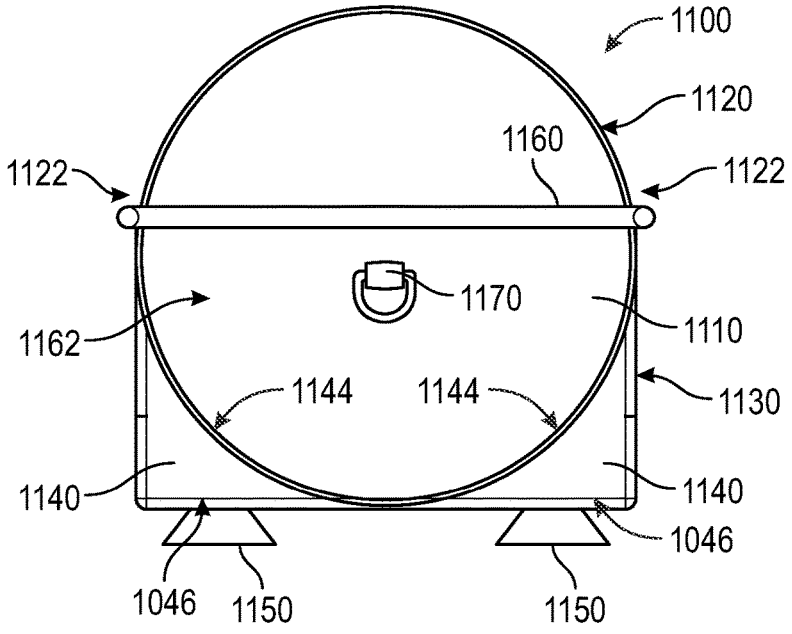
FIG. 12 is a side view of the fender of FIG. 11.

Thus, the exemplary embodiment of a fender 1100 of FIGS. 11 and 12 defines a (e.g.) vinyl bladder 1110 and shell or cover 1120 overlying the bladder on an arcuate portion thereof. The bladder in this embodiment can be a sealed enclosure that is filled with pressurized air, gas, gel or other fluid and that can be open on the interior or contain sealed or perforated baffles. For the purposes of the description herein, the bladder of various embodiments can be broadly termed a "cushion" as it includes an enclosed, shock and impact-absorbing/dampening fluid. The bladder 1110 is cylindrical (for example, a conventional, commercially available fender) in this embodiment, and the shell 1120 can be formed to conform generally to the shape of the bladder surface. The diameter of the bladder can be highly variable within a range of generally acceptable fender sizes. The shell 1120 is joined at opposing edges 1122 to a retaining structure 1130 that can be an elastomeric fabric and/or otherwise tensioned to restrain the shell 1120 against the bladder 1110. Hence, it circles the lower portion of the bladder 1110 and can include integral base blocks/wedges 1140, constructed from foam or plastic (e.g. TPE) that conform to the shape of the bladder 1110 with arcuate inner surface 1144. The retaining fabric/structure 1130 includes tabs 1134 (three-per-side in this example) passes through a plurality of longitudinal slots 1128 on each of opposing sides of the shell/cover 1120. The tabs can be permanently attached via (e.g. sewed seams, or can be removably/adjustably attached via fasteners—for example, hook-and-loop fasteners.

The external/bottom surface 1146 of the base wedges 1140 are each flattened to conform to the shape of the hull. Note, that the flattened bottom surface 1146 can be slightly concave where appropriate to accommodate the curvature of the hull. In various embodiments, the materials used for the bottom can allow for flexure to conform to a curved hull shape within appropriate geometric surface parameters. The base wedges afford cushioning properties against the hull side and also provide for the dispersion of load over a larger surface area of the hull to reduce the potential for impact damage. The base wedges can be mounted on the opposing side (adjacent the shell 1120) to provide further impact resistance if desired and can be held in place with straps, elastomeric fabric, etc.

The retaining structure 1130 include, or allow for the pass-through from the base wedges 1140 of, suction cups 1150 of appropriate size and shape—for example any sufficiently flexible, gas-impermeable and rugged material, including TPE, rubber or vinyl. The number and spacing of such cups 1150 is highly variable, depending upon the size of the fender and desired holding force. In various embodiments, the suction cups can be affixed to the cushioned base bottom 1146 mechanically, adhered or co-molded to the fabric body and or foam padding. More particularly, the number and size of which to be optimized to the size of a particular fender. Furthermore, the number and size of suction cups, in conjunction with the bladder material, define the holding force of the fender which can be optimized to allow sufficient holding force without (free of) rendering the fender unnecessarily difficult to remove from the hull.

The shell 1120 is maintained laterally on the bladder 1100, against sliding off, by straps or bands 1160 that pass around and provide tension against the ends 1162 of the bladder. The bands or other structures can engage fixation points, such as eyelets or (e.g.) metal D-rings 1170 with bases and/or structures unitarily molded in the bladder vinyl.

More generally, the shell/cover according to various embodiments can be sufficiently flexible to accommodate some variation in fender size via the use of elastic/elastomeric materials and/or adjustable fasteners, such as buckles, hook-and-loop fasteners, or similar arrangements. Alternatively a fabric-like flexible material can be used for the body of the shell/cover in combination with strapping that attaches the hull side suction cup section to the bladder.

The shell/cover can be constructed from ¼ to ½ inch-thick material, and can be sized and arranged to cover approximately one-quarter to one-half of the surface area of the fender, and more particularly along the area likely to be contacted by the adjacent surface under maximum compression. More particularly, the shell/cover extends longitudinally substantially along the length of the bladder/fender.

It should be clear that the shell/cover 1120 and associated retaining structure, base wedges, etc., can be part of a retrofit kit purchased by a user for attachment to an otherwise conventional fender, such as those available from Taylor-Made®, and/or other manufacturers/suppliers.

Figure 13:
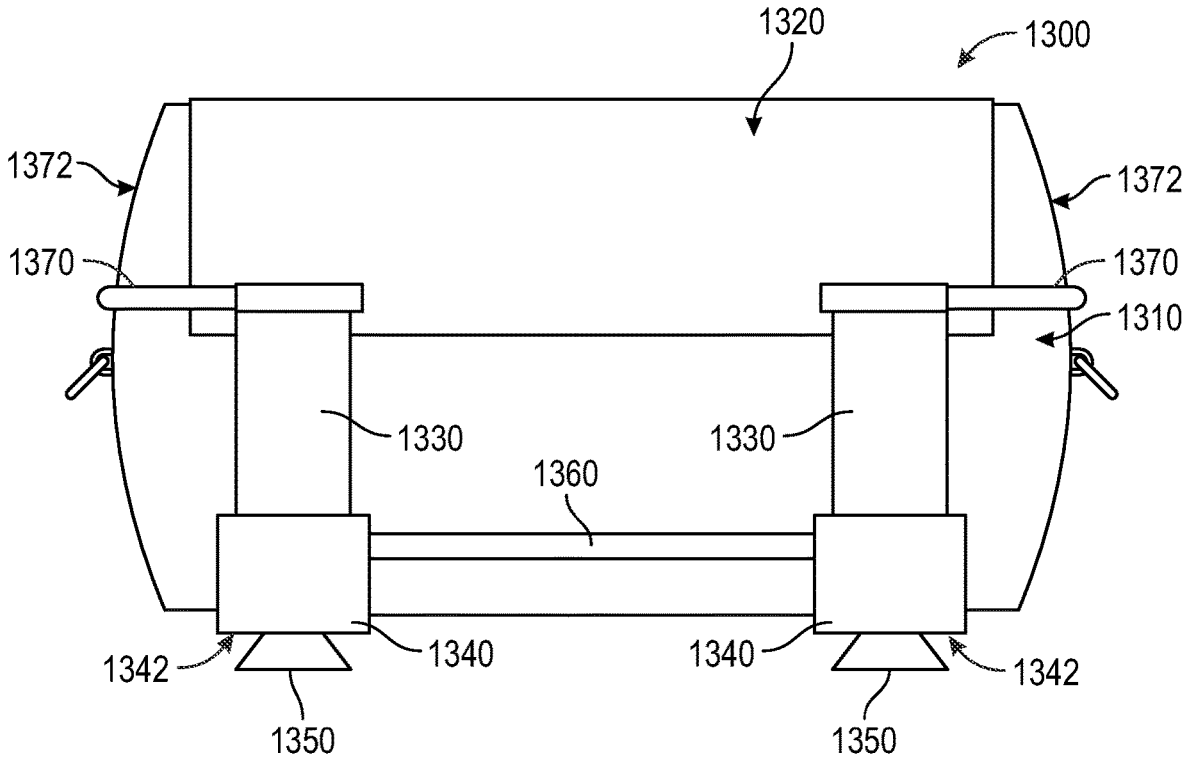
FIG. 13 is a side view of a rope-style (conventional) cylindrical, inflatable fender having a durable polymer shell mounted along one side thereof and an opposing adherence structure composed of cushioned (e.g. foam) base wedges with a flattened bottom and attached suction cups, in which the wedges are separated by connecting members and attached to the shell via straps.
Figure 14:
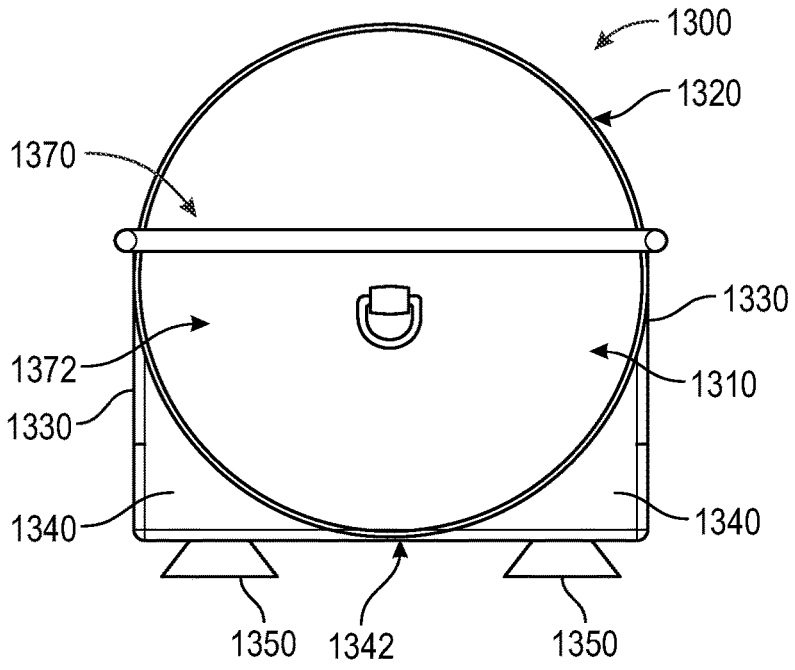
FIG. 14 is a side view of the fender of FIG. 13.

With reference to the embodiment of a fender 1300 shown in FIGS. 13 and 14, the (e.g. conventional) cylindrical, rope fender (also termed a "bladder") 1310 includes a shell/cover 1320 that is secured with elastomeric strips or straps. These are joined to wedge bases 1340 or cradles constructed from an appropriate foam or other cushioning material that provides a forming layer that allows for a space-filling intermediary between the cylinder of the bladder and flattened geometry of the hull. The flattened bottoms 1342 of the bases 1340 each include plurality of suction cups 1350 along the length of the base (see FIG. 14). While two suction cups 1350 are employed, more or fewer cups can be mounted to each base bottom 1342. A connecting rod or strap 1360 can tie the bases 1340 together on each side of the fender 1300. The shell/cover 1320 is secured to each end 1372 of the bladder 1310 by encircling cords or straps 1370 that function in a manner described above (FIGS. 11 and 12).

Figure 15:
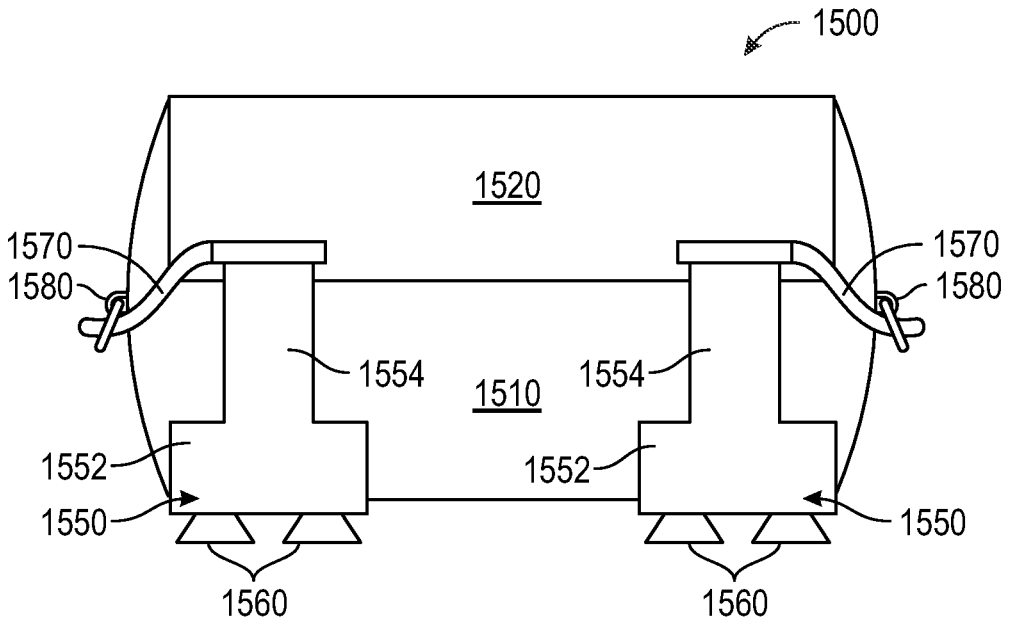
FIG. 15 is a side view of a rope-style (conventional) cylindrical, inflatable fender having a durable polymer shell mounted along one side thereof and an opposing adherence structure composed of cushioned (e.g. foam) base wedges with a flattened bottom and attached suction cups, in which the shell is secured laterally using retaining cords passing through opposing fender fixation points.
Figure 16:
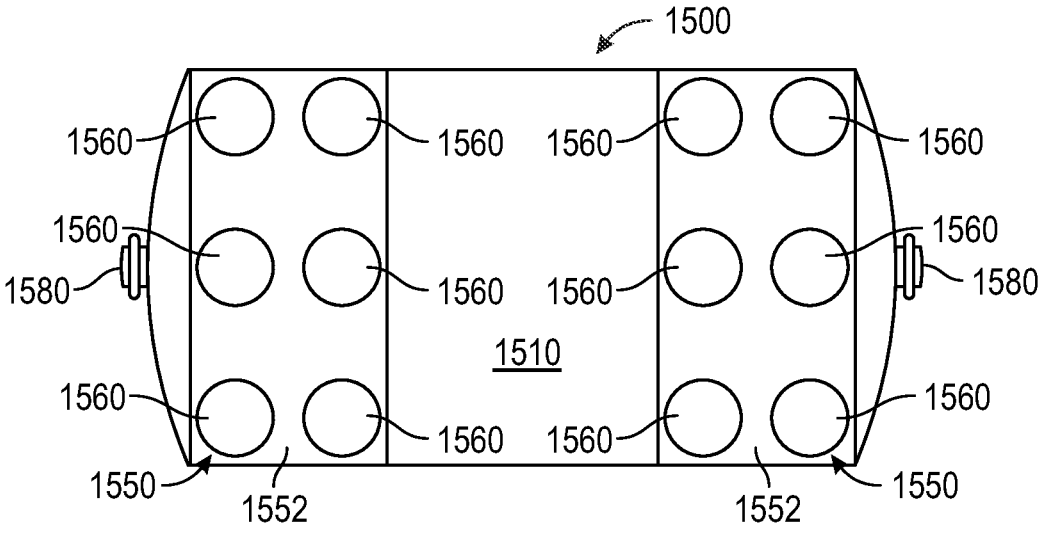
FIG. 16 is a bottom view of the fender of FIG. 15.
Figure 17:
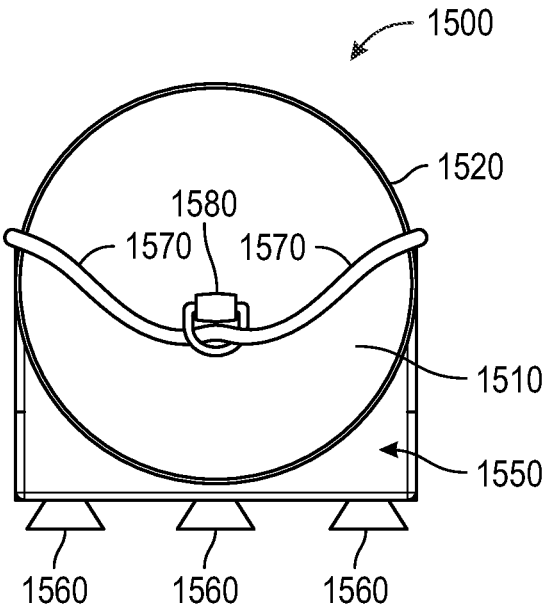
FIG. 17 is a side view of the fender of FIG. 16.

Reference is now made to the illustrative fender 1500 shown in FIGS. 15-17. The fender 1700 is adapted from a conventional, cylindrical fender bladder 1500. The shell/cover 1520 is mounted along a portion of the bladder 1510. The cushioned/padded bases 1550 are secured to the opposing edges of the cover 1520 by appropriate (narrowed) elastic fabric pieces 1554 to bias the cover 1520 in tension against the bladder 1510. The fabric pieces 1554 connect widened bases 1552 that are adapted to support an array of suction cups 1560 disposed along the length and width of the bottom face of each base 1552. The cup array in this example consists of a row having three cups 1560 across the base width and two rows along the length. It is expressly contemplated that the number, size and arrangement of the base cup array is highly variable in alternate embodiments. The cover 1520 is retained laterally in the length/longitudinal direction by a tensioned cord 1570, on each of opposing ends of the bladder 1510. To enhance stability, the cord 1570 passes through the molded fixation point 1580 on each end of the bladder. This mounting arrangement also induces a downward force component to assist in retaining the opposing ends of the cover in biased engagement with the bladder.

Figure 18:
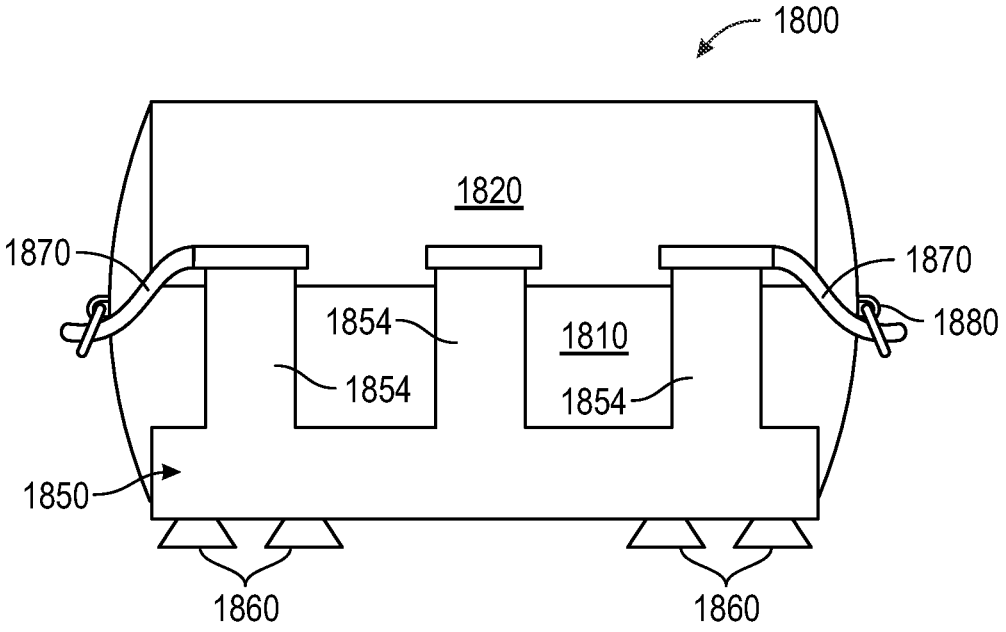
FIG. 18 is a side view of a rope-style (conventional) cylindrical, inflatable fender having a durable polymer shell mounted along one side thereof and an opposing adherence structure composed of cushioned (e.g. foam) base assembly with connecting tabs attached to edges of the shell, and with a flattened bottom and attached suction cups, in which the shell is secured laterally using retaining cords passing through opposing fender fixation points.
Figure 19:
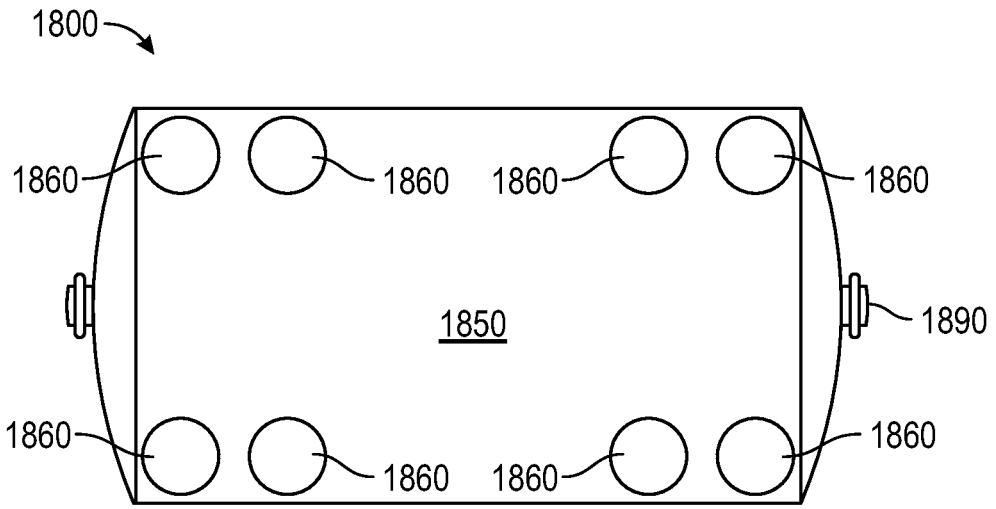
FIG. 19 is a bottom view of the fender of FIG. 18.
Figure 20:
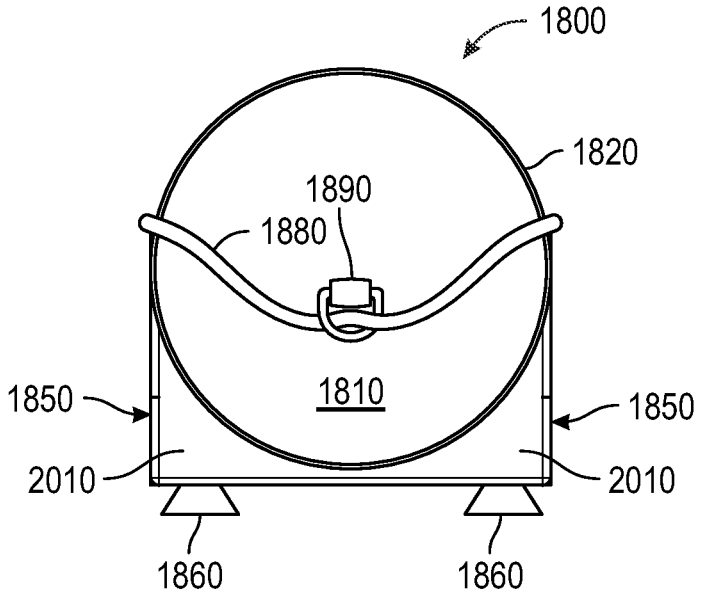
FIG. 20 is a side view of the fender of FIG. 18.

In another exemplary embodiment of the fender 1800, shown in FIGS. 18-20, the shell/cover 1820 is retained against the bladder 1810 by a base assembly 1850 that includes three narrow strips of fabric 1854. The base assembly 1850 further defines a pair of opposing, cushioned base wedges 2010 (FIG. 20) that extend along the length of the bladder 1810. Each base wedge 2010 supports at least two pairs of suction cups 1860 in a spaced-apart arrangement along the length thereof. More suction cups can be provided along the length as appropriate. A retaining cord 1870 passes through a fixation point 1880 on each end of the bladder 1810.

Figure 21:
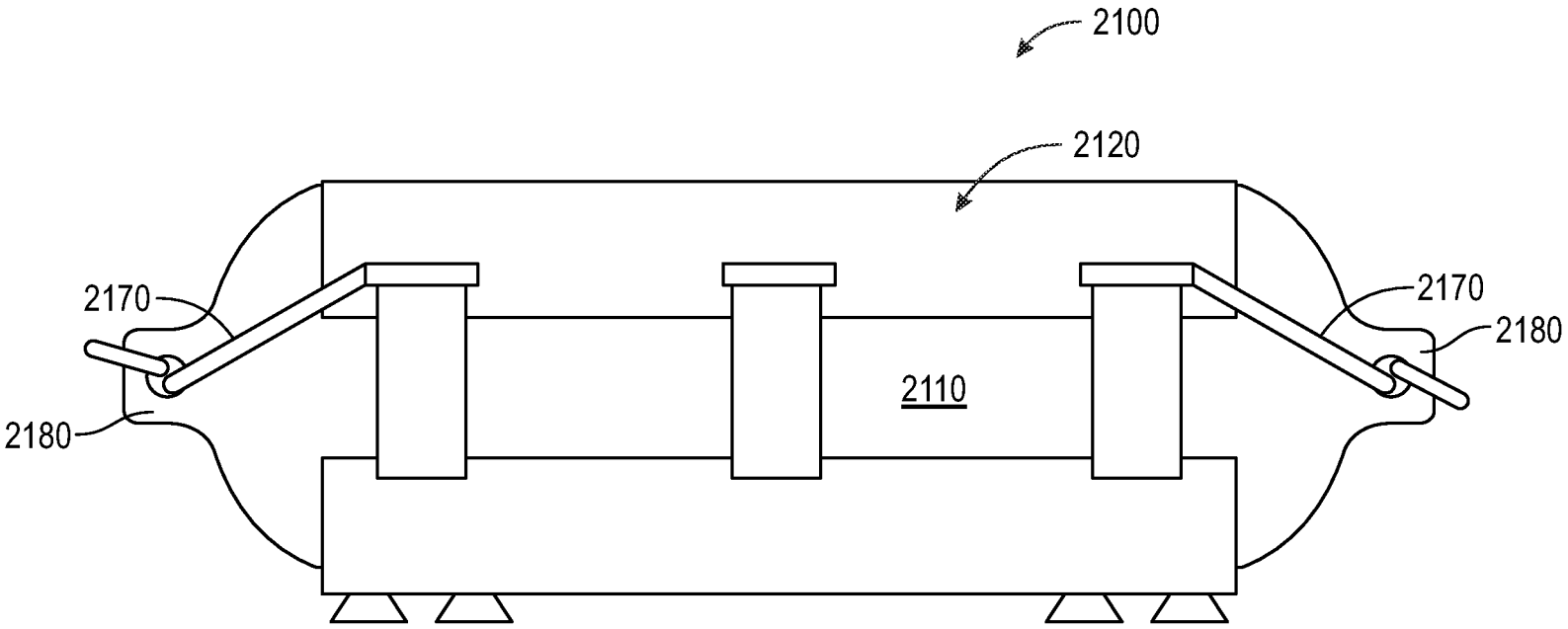
FIG. 21 is a side view of an eyelet-style (conventional) cylindrical, inflatable fender having a durable polymer shell mounted along one side thereof and an opposing adherence structure composed of cushioned (e.g. foam) base assembly with connecting tabs attached to edges of the shell, and with a flattened bottom and attached suction cups, in which the shell is secured laterally using retaining cords passing through opposing fender eyelets.

FIG. 21 depicts a fender arrangement 2100, which is functionally similar to the rope fender embodiments of FIGS. 18-20. The fender 2100 consists of a bladder 2110 and overlying shell/cover 2120, in which the bladder 2110 comprises a conventional, inflatable (e.g.) vinyl fender with opposing, unitarily molded eyelets 2180 on each end. Retaining cords 2170 extend through each eyelet 2180 to assist in restraining the cover 2120 against the bladder 2110. Note that the embodiments of FIGS. 12-16 can be employed using an eyelet-ended, conventional fender according to various, alternate embodiments.

Figure 22:
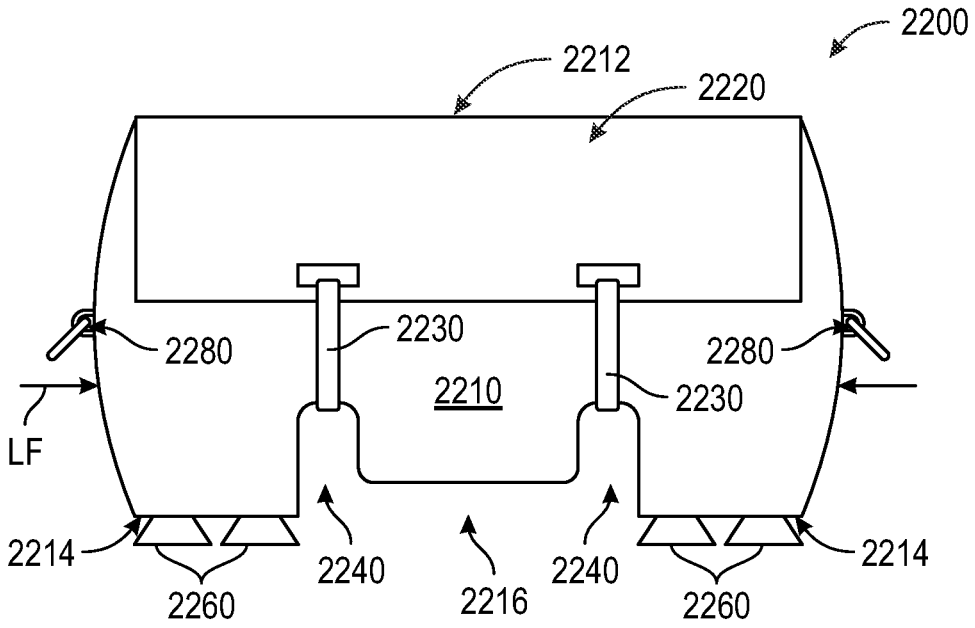
FIG. 22 is a side view of a rope-style fender having a custom-formed, D-shaped-profile, bladder with a flattened bottom and semi-cylindrical/curved top with overlying, durable shell, in which the shell is retained radially and laterally by tensioned straps that engage molded slots on the bottom of the bladder.
Figure 23:
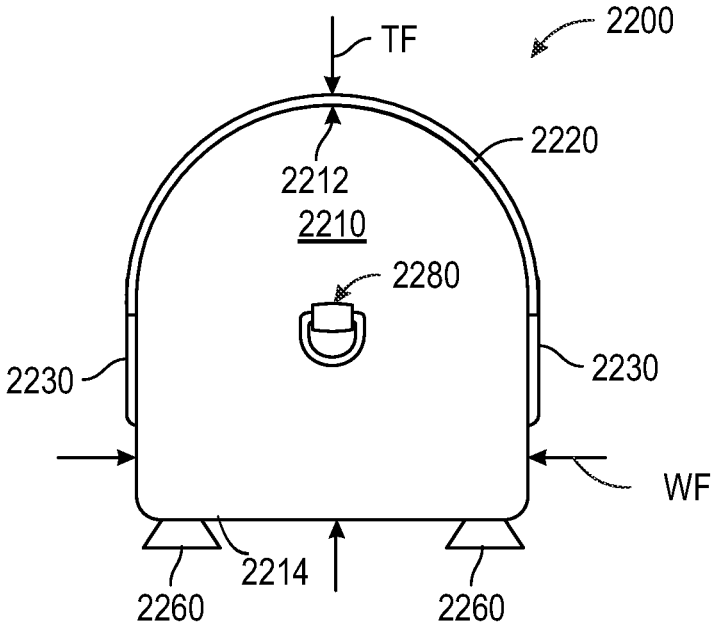
FIG. 23 is a side view of the fender of FIG. 22.

FIGS. 22 and 23 show a fender arrangement 2200 with a customized bladder 2210 that defines a generally D-shaped side profile/cross-section (FIG. 23) with a semi-cylindrical side 2212 and opposing, flattened side 2214. The bladder 2210 is sized and arranged in a manner similar to conventional (e.g. rope) fenders, and can be manufactured in a plurality of sizes to accommodate boats of varying size and types. Generally these will range in dimensions of approximately 6-18 inches thick (TF), 6-20 inches wide (WF) and 24-40 long/high (LF). The fender 2200 includes a shell/cover 2220 that is adapted to cover the curved side 2212 of the bladder 2210 sufficiently to protect bladder against external obstacles while not unduly limiting the flexibility characteristics of the bladder. The shell/cover overlies approximately one-quarter to one-half of the total surface area of the bladder 2210 is generally appropriate. The shell/cover can define material with a thickness of approximately ⅛ inch to ½ inch. The shell/cover can be appropriately flat or curved to accommodate the shape of the bladder side. It can formed from plastic sheet (e.g. HDPE) molded and/or extruded using various techniques known to those of skill and can include multiple layers that are adhered and/or co-molded together—for example a harder outer later and softer inner layer.

In the depicted fender embodiment 2200, the shell/cover 2220 is retained against both radial and lateral motion relative to the bladder 2210 using a pair of encircling straps (webbings) or cords 2230 that can be elastic or non-elastic, and reside in grooves 2240 formed in the bottom of the bladder 2210. These straps or cords can be further attached and/or adjusted using buckles, hook-and-loop fasteners, and the like. In this example, the flattened bottom 2214 at each fender end includes (for example) four suction cups 2260. More or fewer can be provided as appropriate. The central region 2216 of the fender bottom is optionally recessed to render it spaced-apart from the hull when attached. The fixation points 2280 at opposing ends of the fender 2200 are arranged as a rope fender design. An eyelet design can be employed in alternate embodiments.

Figure 24:
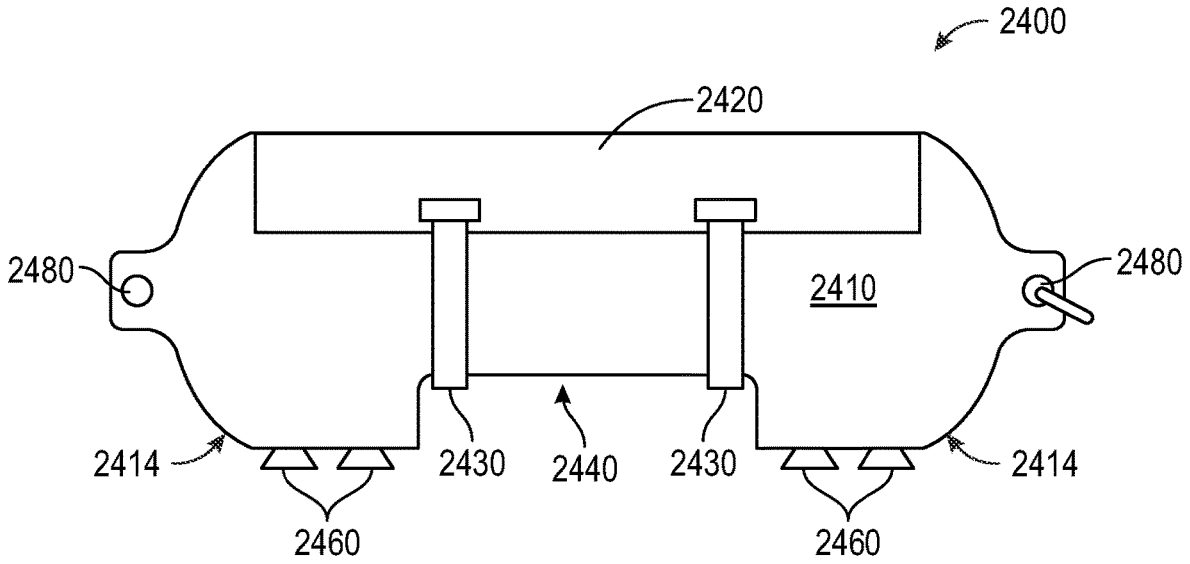
FIG. 24 is a side view of an eyelet-style fender having a custom-formed, D-shaped-profile, bladder with a flattened bottom and semi-cylindrical/curved top with overlying, durable shell, in which the shell is retained radially and laterally by tensioned straps that engage a central, molded recess on the bottom of the bladder.

FIG. 24 shows an exemplary embodiment of a fender 2400 with (optional) eyelets 2480. The shell/cover 2420 is restrained against the custom-shaped bladder 2410 in both lateral/longitudinal and radial directions using a pair of encircling straps or cords 2430 that reside in an elongated, central recess 2440 residing between opposing flattened bottoms 2414. The bottoms 2414 each carry a plurality (e.g. four) suction cups 2460.

Figure 25:
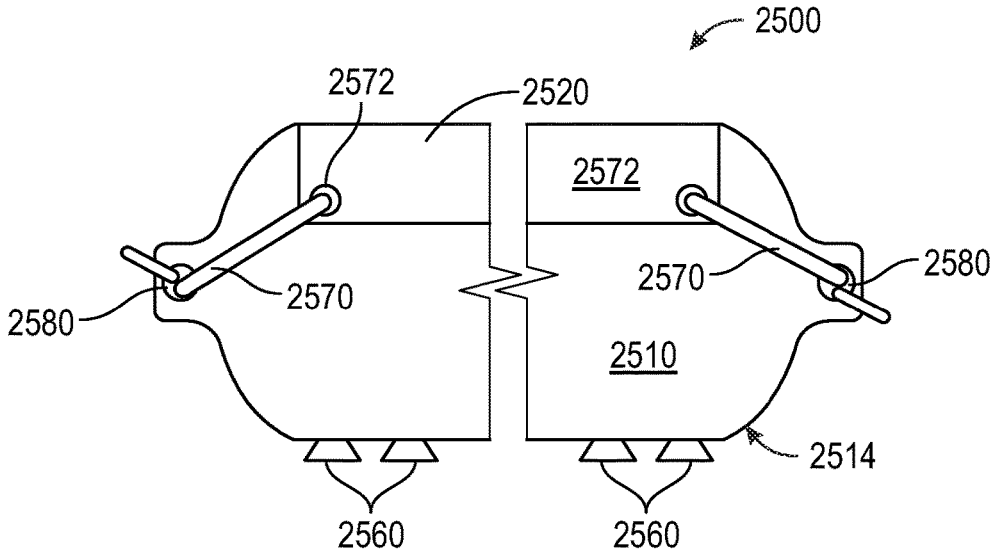
FIG. 25 is a side view of an eyelet-style fender having a custom-formed, D-shaped-profile, bladder with a flattened bottom and semi-cylindrical/curved top with overlying, durable shell, in which the shell is retained radially and laterally by tensioned straps that pass through opposing, adjacent eyelets on each of opposing ends of the bladder.
Figure 26:
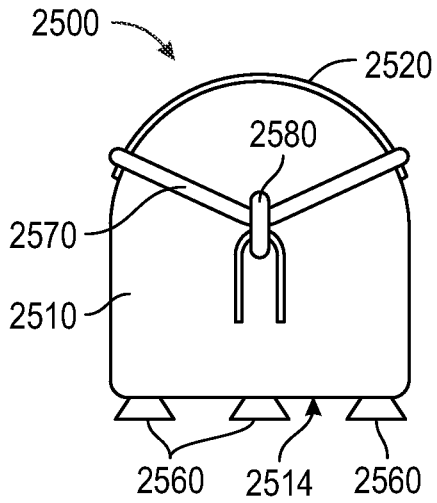
FIG. 26 is a side view of the fender of FIG. 25.

According to another exemplary embodiment, shown in FIGS. 25 and 26, a fender 2500 is provided using a customized bladder 2510 having a flattened bottom 2514 and opposing end eyelets 2580 (or other appropriate fixation points). The shell/cover 2520 is secured against the side of the bladder 2510 using elastic or non-elastic, tensioned cords 2570 that pass through the eyelets 2580, and join opposing corners (via (e.g. grommets 2572) of the shell/cover 2520. As shown, the bottom 2514 of the bladder 2510 is flat along some or all of its surface, and carries a plurality of suction cups 2560 appropriate to the size and shape of the fender 2500.

Figure 27:
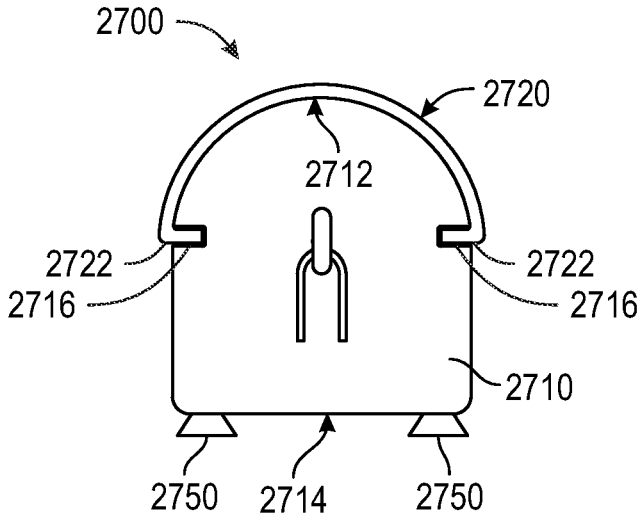
FIG. 27 is a side view of a fender having a custom-formed, D-shaped-profile, bladder with a flattened bottom and semi-cylindrical/curved top with overlying, durable shell, in which the shell is retained radially and laterally by interengaging tabs on the edges of the shell and grooves formed into the surface of the bladder that receive the tabs.

FIG. 27 shows an embodiment of a fender 2700 in which a rigid but otherwise impact/shock-absorbing shell/cover 2720 is fastened to the curved top 2712 of the bladder 2710 using an interengaging fit between inward-directed ends (elongated tabs) 2722 and conforming slots 2716 along each of opposing sides of the bladder 2710. The ends 2716 can be held in the slots 2716 by friction and/or other fastening mechanisms, including adhesives, plastic welding, fasteners, etc. A flattened bottom 2714 carries a plurality of suction cups 2750 that can be arranged in any appropriate number and/or configuration. It should be noted that slots, detents, ports and other geometric shapes can be molded into the bladder to facilitate fastening of the shell/cover and/or to achieve other objectives.

Note that where tabs and grooves engage, the connection can be further enhanced by welding, adhesives, fasteners and/or protrusions/detents that create a snap fit.

Figure 28:
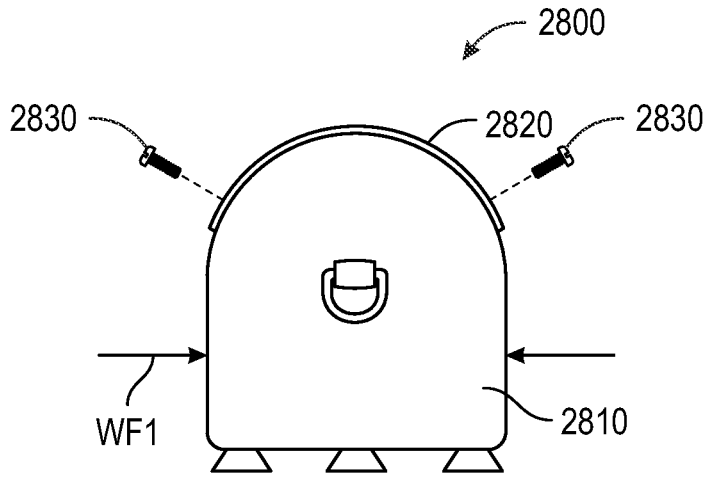
FIG. 28 is a side view of a fender having a custom-formed, D-shaped-profile, bladder with a flattened bottom and semi-cylindrical/curved top with overlying, durable shell, showing exemplary fasteners to secure the shell to the bladder and generally depicting a standard/narrow width configuration for use in various applications.

More generally, a variety of techniques and/or mechanisms can be employed to fasten the shell/cover to the bladder. For example, metal or plastic rivets (e.g. similar to automotive/marine trim fasteners) can be secured through holes in the shell/cover and into female recesses or detents molded into the bladder surface. Alternatively, protrusions can be formed or fused onto the bladder surface that pass through holes on the shell/cover. These protrusions are then secured with snap caps, threaded nuts, etc. Protrusions or detents can also be formed on the shell/cover itself to interengage with mating structures on the bladder. The shell/cover ac also be co-molded with the side of the bladder during manufacture. By way of non-limiting example, FIG. 28 shows a fender 2800 with a typical profile shape, as described above, which employs separate fasteners 2830 to secure the shell/cover 2820 to the curved top of the bladder 2810.

Figure 27A:
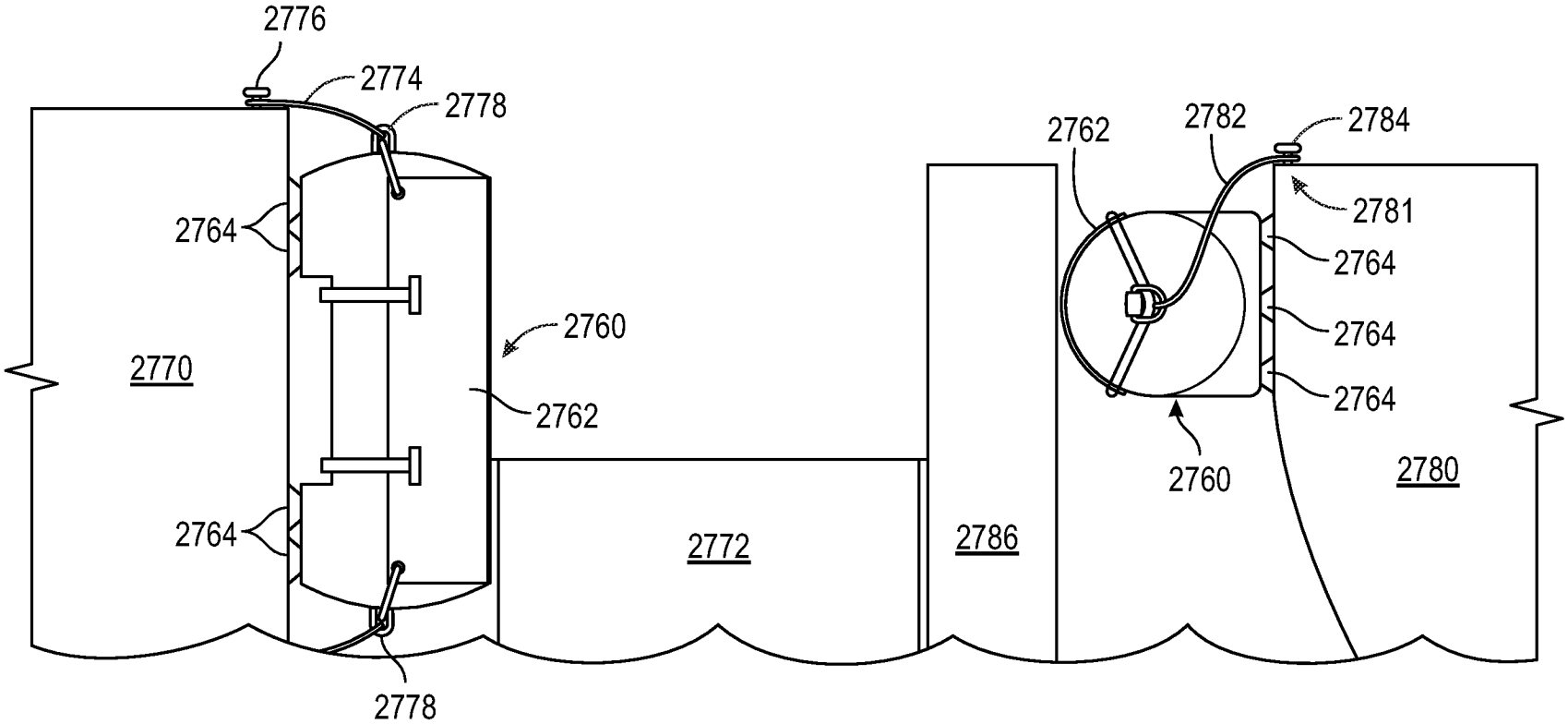
FIG. 27A is a diagram showing exemplary deployment of fenders with custom-formed, D-shaped bladders secured (via suction cups) to the sides of respective hulls in both a vertical and latitudinal (horizontal) configuration to resist damage by a dock, pile or other fixed obstruction.

FIG. 27A shows an exemplary fender 2760 with molded bladder and attached shell/cover 2762 in operation in various configurations. The fender is arranged vertically with respect to a hull 2770 with suction cups 2764 engaging the hull surface and a portion of the shell/cover 2762 engaging the side of a dock 2772. The fender is secured to the hull at an appropriate elevation using a rope/line 2774 attached between a deck cleat 2776 (or another attachment location) and the fender fixation point (or eyelet) 2778. The collective securing action of a line 2774 and suction cups 2764 ensures a relatively stationary position for the fender 2760 with respect to the hull 2770 and deck 2772, which holds even in rough weather.

Similarly, in the example of FIG. 27A, another hull 2780 carries the fender 2760 in a lateral/horizontal configuration near the gunwale 2781 in a rub rail configuration. The fender 2760 in this configuration is typically supported by opposing lines 2782 that extend between opposing fixation points 2778 and cleats 2784 (or other locations, such as stanchions) on the deck. Suction cups 2764 engage the hull surface to resist vertical or horizontal sliding and other motion away from the hull surface. Thus, the fender shell/cover 2762 faces a pile 2786, and provides continuous and effective protection against impact or rubbing between the hull 2780 and pile 2786, even in relative rough seas.

Figure 29:
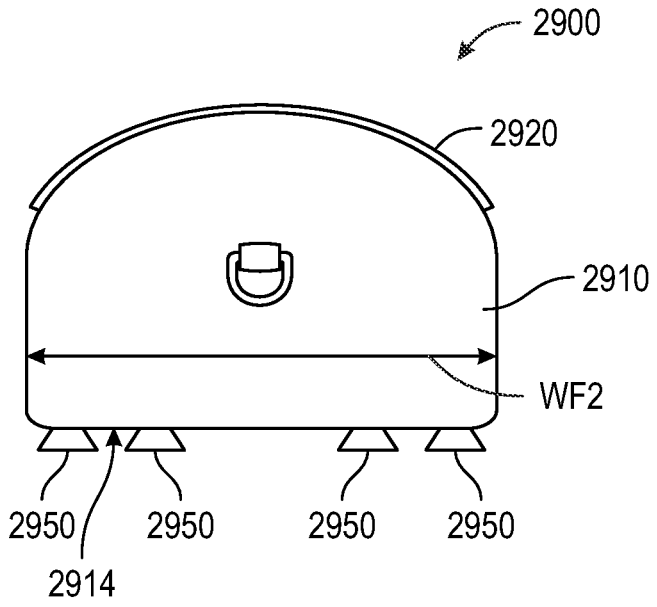
FIG. 29 is a side view of a fender having a custom-formed, D-shaped-profile, bladder with a flattened bottom and semi-cylindrical/curved top with overlying, durable shell, generally depicting a widened width configuration for use in particular applications.

The molded bladder according to various embodiments herein can be adapted to particular circumstances and uses. The configuration of FIG. 28 is a generally narrow configuration in terms of width WF1, and is similar (or somewhat narrower) in aspect ratio relative to many conventional cylindrical fenders. Conversely, FIG. 29 shows a wide configuration fender 2900 that defines a width WF2 that can be wider than a conventional arrangement for certain applications. The for example, the width can be approximately 50-100 percent wider than the fender 2800 in FIG. 28. The shell/cover 2920 can be attached to the bladder 2910 using any acceptable fastening technique (e.g. fasteners, straps, cords, adhesives, interengaging slots and tabs, etc. The bottom 2914 is flattened and contains additional suction cups across its width in this example. The actual number and/or arrangement of cups on the fender bottom of the exemplary wide style fender is highly variable and can be provided based upon desired performance.

Figure 30:
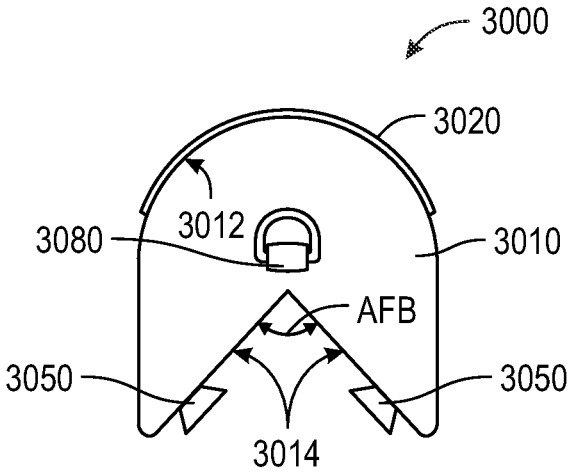
FIG. 30 is a side view of a fender having a custom-formed, D-shaped-profile, bladder with a V-shaped bottom and semi-cylindrical/curved top with overlying, durable shell, for use in protecting the bow of a boat hull.
Figure 31:
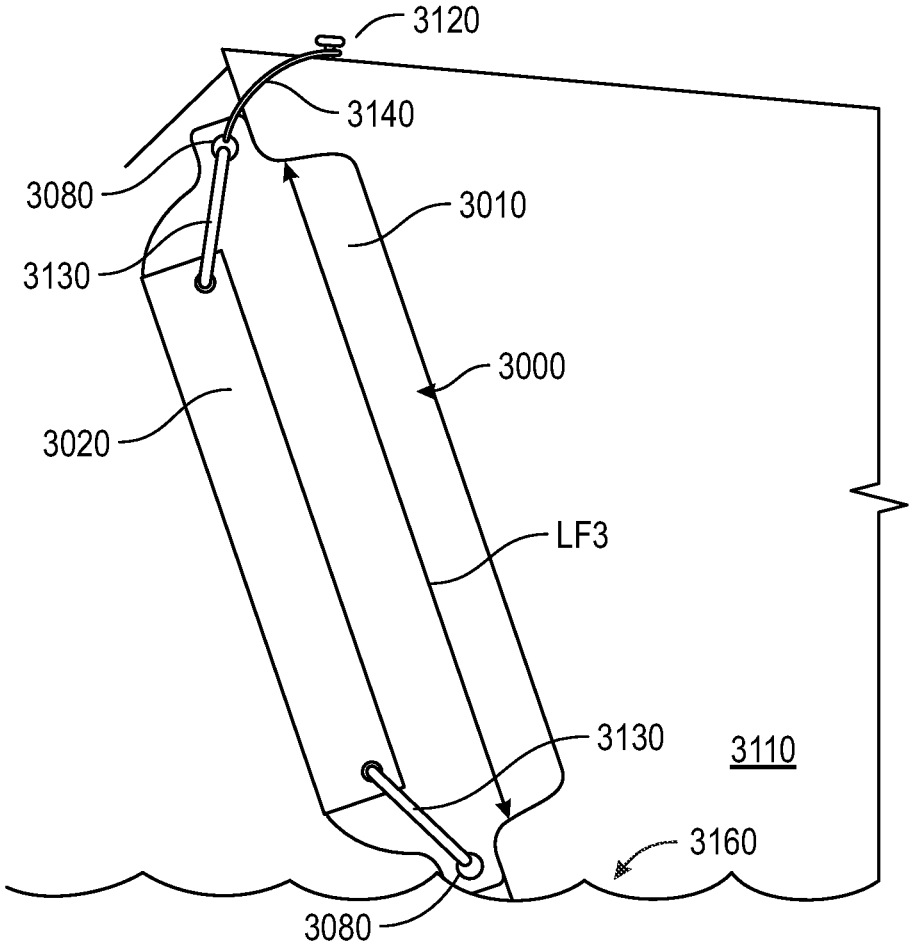
FIG. 31 is a fragmentary side view of the bow of an exemplary boat hull showing the fender of FIG. 30 attached thereto.

In another embodiment of a fender 3000, shown in FIGS. 30 and 31, the molded bladder 3010 is adapted to protect the V-shaped bow of an exemplary boat hull 3110 (FIG. 31). As such, the bottom 3014 of the bladder is shaped in a V, with an angle AFB that approximately conforms to the typical angle of a bow. Note that bladders in a range of angles AFB can be provided to accommodate different, prevailing shapes of bows. The flattened bottoms 3014 of the V can each carry a plurality of suction cups 3050 in a size, and number appropriate to the desired holding force. One vertical row (FIG. 30) is shown on each bottom side 3014, but two or more rows can be employed in larger fender designs for larger boats. The cover 3020, opposite the V-shaped bottom 3014 can be secured to the semi-cylindrical/curved top 3012 via any appropriate fastening technique or mechanism, as described above. The ends of the fender 3000 include eyelets 3080 or other fixation points that are used to secure exemplary shell/cover retaining cords 3130 in this example. As shown in FIG. 31, a securing line 3140 extends between the upper eyelet 3080 and an exemplary deck cleat 3120 that secures the fender 3000 at an appropriate height relative to the bow of the hull 3110.

The longitudinal length LF3 (FIG. 31) of the fender 3000 is highly variable. In this embodiment, it is sufficiently long the run near the top 3150 of the bow to the water line 3160. Alternatively, a plurality of similar, V-bottomed fenders can be arranged in a chain with ties between adjacent eyelets or fixation points 3080.

Note that the fender(s) according to the embodiments herein can be constructed using a variety of techniques that should be clear to those of skill. Several layers can be formed separately and then bound together using heat, adhesives and/or other affirming techniques. The entire structure can be co-molded using appropriate techniques. Fenders can be formed (e.g. molded) as discrete units, or from a continuous feed that is cut to appropriate widths using mechanical or energy-based (e.g. laser, ultrasonic, etc.) cutting techniques.

It should be clear that the above described marine fender provides a system for protecting a boat from neighboring objects, such as docks and other boats, which involves no moving parts, and can be used in individual units or groups of fenders together to provide maximum protection to boats during dangerous conditions such as storms and rough water. These fenders can take advantage of custom molding techniques that allow them to be adapted to particular tasks—such as bow protection and/or can be used to enhance the performance of conventional cylindrical fenders.

The foregoing has been a detailed description of illustrative embodiments of the invention. Various modifications and additions can be made without departing from the spirit and scope of this invention. Features of each of the various embodiments described above may be combined with features of other described embodiments as appropriate in order to provide a multiplicity of feature combinations in associated new embodiments. Furthermore, while the foregoing describes a number of separate embodiments of the apparatus and method of the present invention, what has been described herein is merely illustrative of the application of the principles of the present invention. For example, the fenders can be used on other vehicles such as personal watercraft, automobiles, or other items that can benefit from an added layer of impact/abrasion protection. Also, while suction cups, grippers, etc., as depicted as circular in perimeter, they can define any appropriate shape, including ovular, polygonal, irregular shapes, and/or combinations of such shapes. Likewise, where the adherence structure defines discrete suction cups, such can be substituted with small scale suction surfaces or similar adhesion mechanisms (grippers) according to any embodiment herein. Furthermore, as used herein various directional and dispositional terms such as "vertical", "horizontal", "up", "down", "bottom", "top", "side", "front", "rear", "left", "right", and the like, are used only as relative conventions and not as absolute directions/dispositions with respect to a fixed coordinate space, such as the acting direction of gravity. Additionally, where the term "substantially" or "approximately" is employed with respect to a given measurement, value or characteristic, it refers to a quantity that is within a normal operating range to achieve desired results, but that includes some variability due to inherent inaccuracy and error within the allowed tolerances of the system (e.g. 1-5 percent). Accordingly, this description is meant to be taken only by way of example, and not to otherwise limit the scope of this invention.

What is claimed is:

1. A marine fender comprising:

a cushion that defines a impact absorbing and dampening arrangement and having a predetermined shape and size;

an outer shell covering a portion of the cushion along an area thereof exposed to the impact; and an adherence structure located with respect to the cushion, opposite the outer shell, adapted to secure the marine fender to a hull of a boat, the adherence structure being based upon suction adhesion against a surface of the hull, wherein the cushion comprises a foam material or an inflatable and deflatable bladder, and wherein the bladder comprises a conventional, cylindrical boat fender and the adherence structure includes cradling cushions that cradle the bladder and define an approximately flattened bottom to which the suction cups are attached.

2. The marine fender as set forth in claim 1, wherein the adherence structure comprises (a) a plurality of suction cups at predetermined locations, (b) a microsuction sheet or (c) a nanosuction sheet.

3. The marine fender as set forth in claim 2, wherein the plurality of suction cups each define an elastomeric cup adhered to a portion of the adherence structure.

4. The marine fender as set forth in claim 3, wherein the suction cups are separate components mechanically applied to the adherence structure, and the adherence structure is one of either an approximately flattened bottom of the cushion or an applied cradle that engages approximately cylindrical bladder.

5. The marine fender as set forth in claim 1, wherein the outer shell comprises a rigid or impact and abrasion-resistant polymer.

6. The marine fender as set forth in claim 1, further comprising one or more fixation points.

7. The marine fender as set forth in claim 1 wherein the shell is secured with respect to the adherence structure by a flexible fabric retaining structure.

8. The marine fender as set forth in claim 7, further comprising, lateral retaining cords that encircle each of opposing ends of the bladder or pass through fixation points on the opposing ends of the bladder, respectively.

9. The marine fender as set forth in claim 1 wherein the cradling cushions either (a) extend continuously along a portion of the longitudinal length of the bladder or (b) reside adjacent opposing ends of the bladder.

10. A marine fender comprising:

a cushion that defines a impact absorbing and dampening arrangement and having a predetermined shape and size;

an outer shell covering a portion of the cushion along an area thereof exposed to the impact; and an adherence structure located with respect to the cushion, opposite the outer shell, adapted to secure the marine fender to a hull of a boat, the adherence structure being based upon suction adhesion against a surface of the hull, wherein the cushion comprises a foam material or an inflatable and deflatable bladder, and wherein the bladder defines an approximate D-shaped cross section with an approximately flattened side and an opposing, semi-cylindrical or curved side, the shell being secured against the semi-cylindrical or curved side and the suction cups being attached to the flattened side.

11. The marine fender as set forth in claim 10 wherein the flattened side includes one or more recesses between each of opposing ends, constructed and arranged to receive retaining cords or straps attached to each of opposing edges of the shell.

12. The marine fender as set forth in claim 11 wherein the shell includes formations that interengage with associated formation of the bladder to secure the shell and the bladder together.

13. A marine fender comprising:

a cushion that defines a impact absorbing and dampening arrangement and having a predetermined shape and size;

an outer shell covering a portion of the cushion along an area thereof exposed to the impact; and an adherence structure located with respect to the cushion, opposite the outer shell, adapted to secure the marine fender to a hull of a boat, the adherence structure being based upon suction adhesion against a surface of the hull, wherein the cushion comprises a foam material or an inflatable and deflatable bladder, and wherein the bladder defines an approximate D-shape cross section with a semi-cylindrical or curved side, the shell being secured against the semi-cylindrical or curved side and an opposing V-shaped side with the suction cups being attached to the each of a pair of flattened sections of the V-shaped side, the suction cups being adapted to engage opposite sides of a bow of the hull.

14. The marine fender as set forth in claim 1 wherein the fender defines an elongated perimeter shape constructed and arranged to provide a rub rail function.

15. The marine fender as set forth in claim 10, wherein the adherence layer structure comprises (a) a plurality of suction cups at predetermined locations, (b) a microsuction sheet or (c) a nanosuction sheet.

16. The marine fender as set forth in claim 15, wherein the plurality of suction cups each define an elastomeric cup adhered to a portion of the adherence structure.

17. The marine fender as set forth in claim 16, wherein the suction cups are separate components mechanically applied to the adherence structure, and the adherence structure is one of either an approximately flattened bottom of the cushion or an applied cradle that engages approximately cylindrical bladder.

18. The marine fender as set forth in claim 12, wherein the outer shell comprises a rigid or impact and abrasion-resistant polymer.

19. The marine fender as set forth in claim 10, further comprising one or more fixation points.

20. The marine fender as set forth in claim 10, further comprising, lateral retaining cords that encircle each of opposing ends of the bladder or pass through fixation points on the opposing ends of the bladder, respectively.

* * * * *